US007269883B2

(12) United States Patent
Savicki

(10) Patent No.: US 7,269,883 B2
(45) Date of Patent: Sep. 18, 2007

(54) CLOSURE DEVICE

(75) Inventor: Alan F. Savicki, Oswego, IL (US)

(73) Assignee: The Clorox Company, Oakland, CA (US)

( * ) Notice: Subject to any disclaimer, the term of this patent is extended or adjusted under 35 U.S.C. 154(b) by 277 days.

(21) Appl. No.: 10/466,881

(22) PCT Filed: Mar. 22, 2001

(86) PCT No.: PCT/US01/09282

§ 371 (c)(1),
(2), (4) Date: Jul. 21, 2003

(87) PCT Pub. No.: WO02/076258

PCT Pub. Date: Oct. 3, 2002

(65) Prior Publication Data

US 2004/0049896 A1 Mar. 18, 2004

(51) Int. Cl.
*A44B 19/16* (2006.01)

(52) U.S. Cl. ..... 24/399; 24/415; 24/427; 383/64; 383/65

(58) Field of Classification Search ..... 24/587, 24/399, 400, 576, 304, 427, 415, 418, 419, 24/401, 402; 383/63, 65, 64; 493/210, 213, 493/214, 215, 267, 927, 929
See application file for complete search history.

(56) References Cited

U.S. PATENT DOCUMENTS 2,571,144 A 10/1951 Lobl
3,054,434 A 9/1962 Ausnit et al.
3,426,396 A 2/1969 Laguerre
3,806,998 A 4/1974 Laguerre
4,262,395 A 4/1981 Kosky
4,342,278 A 8/1982 Horan
4,829,641 A 5/1989 Williams
5,007,143 A 4/1991 Herrington
5,010,627 A * 4/1991 Herrington et al. ..... 24/400
5,301,395 A 4/1994 Richardson et al.
5,664,299 A 9/1997 Porchia et al.
5,722,128 A 3/1998 Toney et al.
5,911,508 A 6/1999 Dobreski et al.
5,950,285 A 9/1999 Porchia et al.
5,953,796 A 9/1999 McMahon et al.
5,983,466 A 11/1999 Petkovsek
6,014,795 A 1/2000 McMahon et al.
6,036,364 A 3/2000 Heuvel
6,220,754 B1 * 4/2001 Stiglic et al. ..... 383/64
6,293,701 B1 * 9/2001 Tomic ..... 383/64
6,317,939 B1 * 11/2001 Malin ..... 24/304
6,526,632 B1 * 3/2003 Blythe et al. ..... 24/400

* cited by examiner

*Primary Examiner*—Jack W. Lavinder
(74) *Attorney, Agent, or Firm*—Ann Lee

(57) ABSTRACT

A container (110) including a closure device (121) is disclosed. The closure device (121) includes a pair of interlocking fastening strips (130, 132) and a slider (134) for occluding and deoccluding the fastening strips (130, 132). The fastening strips (130, 132) are interlocked when the slider (134) is at a first end (136). The slider (134) includes a separator (192) that is configured to urge the fastening strips (130, 132) to wrap around the separator (192) to provide a seal when the slider (134) is at the first end (136) of the fastening strips (130, 132). The slider (134) can include a nose portion (252) for latching the slider (134) at the first end (136) of the fastening strips (130, 132). The slider (134) can include a valve (198). The slider (134) can have different configurations.

47 Claims, 23 Drawing Sheets

CLOSURE DEVICE

FIELD OF THE INVENTION

The present invention relates generally to containers and, more particularly, to a closure device with a slider for occluding and deoccluding the closure device. The invention is particularly well suited for fastening flexible storage containers, including plastic bags.

BACKGROUND OF THE INVENTION

The use of closure devices for fastening storage containers, including plastic bags, is generally known. Furthermore, those skilled in the art, as demonstrated by the numerous patents in this area, generally know the manufacture of closure devices made of plastic materials.

A particularly well-known use for closure devices is in connection with flexible storage containers, such as plastic bags. In some instances, the closure device and the associated container are formed from thermoplastic materials, and the closure device and the side walls of the container are integrally formed by extrusion as a single piece. Alternatively, the closure device and side walls of the container may be formed as separate pieces and then connected by heat sealing or any other suitable connecting process. In either event, such closure devices are particularly useful in providing a closure means for retaining matter within the bag.

A conventional closure device typically utilizes mating fastening strips or interlocking closure elements which are used to selectively seal the bag. In addition, a slider may be provided for use in opening and closing the fastening strips or closure elements. The slider may include a separator, which extends at least partially between the fastening strips. When the slider is moved in the appropriate direction, the separator divides the fastening strips and opens the bag.

The separators currently being used are small and do not provide space for adding an additional feature. In addition, there is a need for a slider which will permit the user to remove or vent air from the container. The present invention provides a larger separator which permits a vent to be added to the slider.

Furthermore, there is a need for a slider with a latching feature to hold the slider in the closed position on the bag. Also, there is a need for a slider with a feature for providing a seal between the slider and the fastening strips.

SUMMARY OF THE INVENTION

The present invention is directed toward a container including a bag and a closure device. The bag includes a first side wall and a second side wall joined together by a first seam and a second seam. The closure device includes a first fastening strip, a second fastening strip, and a slider.

The first and the second fastening strips can be mounted to the first and the second side walls, respectively. The first and the second fastening strips are adapted to interlock with each other over a predetermined length between first and second ends thereof.

The slider is movably disposed on the first fastening strip and the second fastening strip. The slider facilitates the occlusion of the fastening strips when moved toward a first end thereof and the deocclusion of the fastening strips when moved toward a second end thereof. The slider includes a top portion, a pair of side walls depending from the top portion, and a separator depending from the top portion and disposed between the first side wall and the second side wall.

The side walls straddle the fastening strips, and the separator is disposed between the fastening strips.

In accordance with an important aspect of the present invention, the separator includes a first side surface and a second side surface. The surfaces form a body, a wedge for deoccluding the fastening strips, and a tapered plug for providing a seal between the slider and the fastening strips. The fastening strips and the separator of the slider are operably engageable to provide a seal. The slider may include a nose portion for locking the slider into place at the first end of the fastening strips. The body of the slider may include a valve.

The present invention will become more readily apparent upon reading the following detailed description of the exemplified embodiments and upon reference to the accompanying drawings herein.

DESCRIPTION OF THE EXEMPLIFIED EMBODIMENTS

Figure 1:
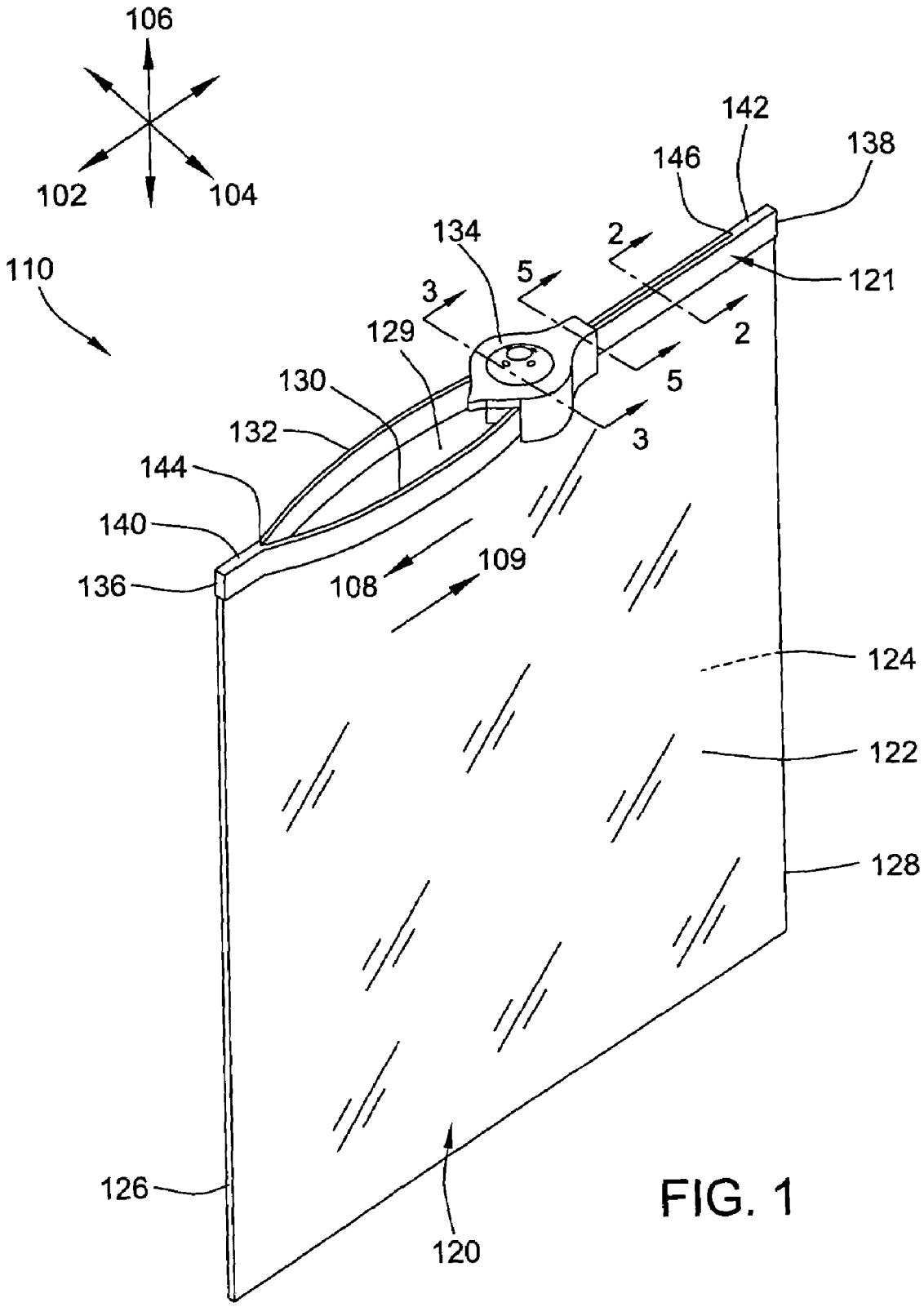
FIG. 1 is a perspective view of a container according to the present invention in the form of a plastic bag.

FIG. 1 illustrates an embodiment of a container 110 in the form of a plastic bag 120 having a sealable closure device 121. The bag 120 includes a first side wall 122 and a second side wall 124 joined at a first seam 126 and a second seam 128 to define a compartment accessible through an open top end 129 but sealable by means of the closure device 121. The closure device 121 includes a first fastening strip 130, a second fastening strip 132, and a slider 134.

The fastening strips 130, 132 and the slider 134 have a longitudinal X axis 102, a transverse Y axis 104, and a vertical Z axis 106. The transverse Y axis 104 is perpendicular to the longitudinal X axis 102. The vertical Z axis 106 is perpendicular to the longitudinal X axis 102. The vertical Z axis 106 is perpendicular to the transverse Y axis 104.

To allow the bag 120 to be opened and closed, the first and second fastening strips 130, 132 are provided. The first fastening strip 130 is attached to the first side wall 122 near the top end 129 of the bag 120. The second fastening strip 132 is attached to the second side wall 124 near the top end 129 of the bag 120. The fastening strips 130, 132 are located across from and substantially parallel to each other and are adapted to be interlocked between a first end 136 and a second end 138 thereof. Interlocking the strips 130, 132 occludes the strips 130, 132 and closes the top end 129. Separating the interlocked fastening strips 130, 132 deocludes the strips 130, 132 and opens the top end 129.

The fastening strips 130, 132 are secured together at the first and the second ends 136, 138 to form a pair of end seals. The fastening strips 130, 132 can include a first end portion 140 and a second end portion 142. The end portions 140, 142 can be held together. For example, the illustrative end portions 140, 142 are melted together by heat sealing, ultrasonic sealing, or other operation. In other embodiments, the end portions 140, 142 can be held together by using an adhesive, plastic clamps, or by some other means.

The edge where the first and the second fastening strips 130, 132 merge to form the end portion 140 at the first end 136 of the closure device 121 serves as a first end stop 144 for the slider 134. Likewise, the edge where the first and the second fastening strips 130, 132 merge to form the end portion 142 at the second end 138 of the closure device 121 serves as a second end stop 146 for the slider 134.

To facilitate the occlusion and deocclusion of the fastening strips 130, 132, the slider 134 is provided. The slider 134 is mounted onto the fastening strips 130, 132 so that the slider 134 is restrained from being removed from the fastening strips 130, 132 in the Z axis 106 but free to slide along the X axis 102 between the first and second ends 136, 138. The slider 134 engages the fastening strips 130, 132 so that when the slider 134 moves in an occlusion direction 108 toward the first end 136, the fastening strips 130, 132 interlock. When the slider 134 moves in a deocclusion direction 109 toward the second end 138, the fastening strips 130, 132 separate. The occlusion and deocclusion directions 108, 109 are substantially parallel to the X axis 102. When the slider 134 is at the first end 136, the bag 120 is sealed. When the slider 134 is at the second end 138, the bag 120 is fully open.

Figure 2:
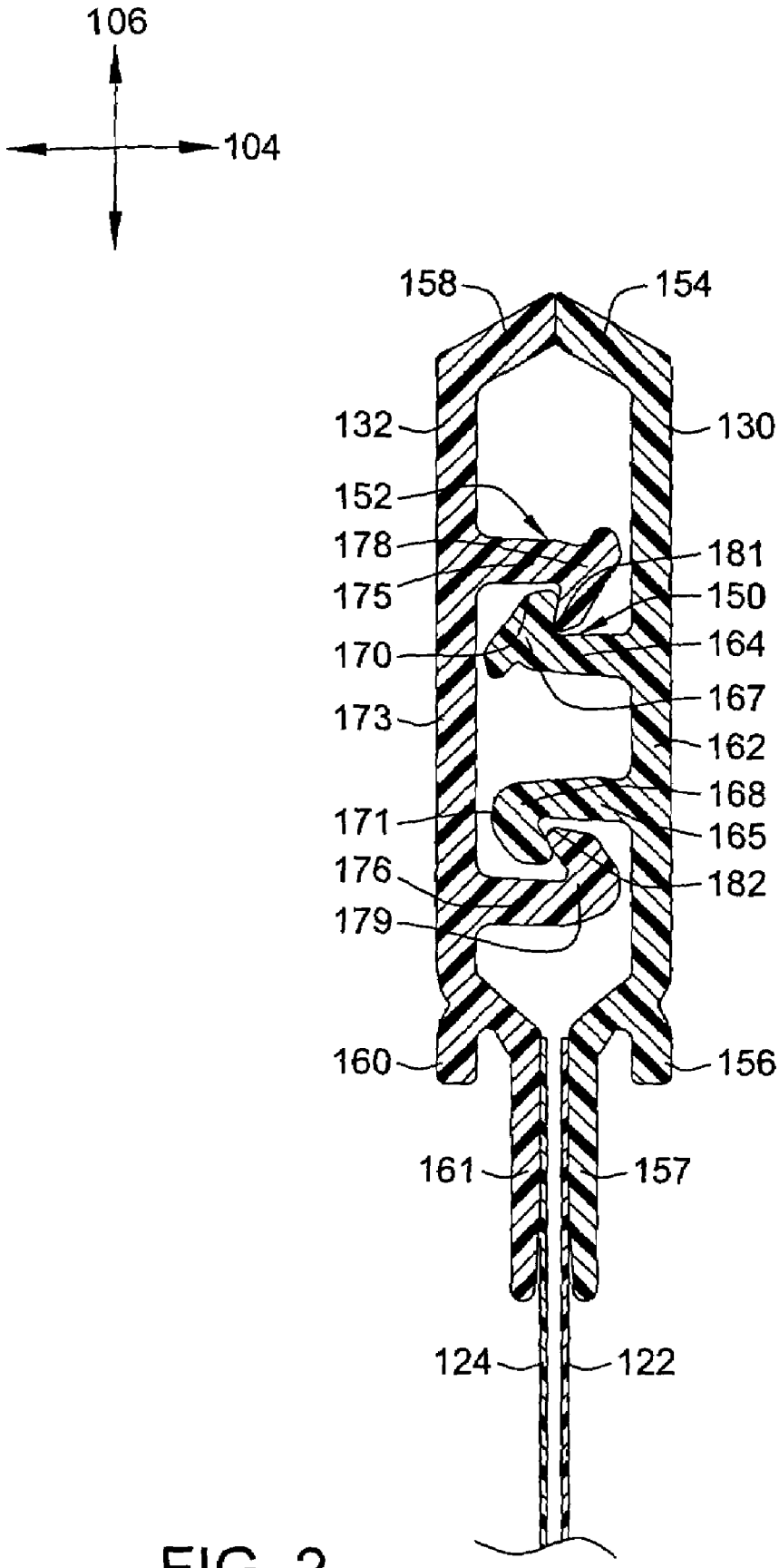
FIG. 2 is a partial cross-sectional view of the container taken along line 2-2 in FIG. 1.

FIG. 2 shows the illustrative pair of U-channel fastening strips 130, 132. The first fastening strip 130 includes a first closure element 150, and the second fastening strip 132 includes a second closure element 152. The first closure element 150 engages the second closure element 152. The first fastening strip 130 may include a flange 154 disposed at the upper end of the first fastening strip 130 and a rib 156 disposed at the lower end of the first fastening strip 130. The first fastening strip 130 may also include a flange portion 157. Likewise, the second fastening strip 132 may include a flange 158 disposed at the upper end of the second fastening strip 132 and a rib 160 disposed at the lower end of the second fastening strip 132. The second fastening strip 132 may also include a flange portion 161. The first and second side walls 122, 124 of the plastic bag may be attached to the first and second fastening strips 130, 132, respectively, by conventional manufacturing techniques.

The first closure element 150 includes a base portion 162. A pair of spaced-apart, parallely-disposed upper and lower webs 164, 165 extends from the base 162. The base 162 and the webs 164, 165 form a U-channel closure element. The upper and lower webs 164, 165 include an upper and a lower hook closure portion 167, 168, respectively, extending from the respective web 164, 165 and facing away from each other. The hook closure portions 167, 168 include a respective guide surface 170, 171, which generally serve to guide the upper and lower hook closure portions 167, 168 for occlusion with an upper and a lower hook closure portion 178, 179 of the second closure element 152, respectively. The guide surfaces 170, 171 may also have a rounded crown surface.

The second closure element 152 includes a base portion 173. A pair of spaced-apart, parallely-disposed upper and lower webs 175, 176 extend from the base 173. The base 173 and the webs 175, 176 form a U-channel closure element. The upper and lower webs 175, 176 include the upper and the lower hook closure portions 178, 179, respectively, extending from the respective web 175, 176 and facing toward each other. The hook closure portions 178, 179 include a respective guide surface 181, 182 which generally serve to guide each hook closure portion 178, 179 for occlusion with the upper and the lower hook closure portions 167, 168 of the first closure element 150, respectively. The second closure element 152 may include a color enhancement member which is described in U.S. Pat. No. 4,829,641.

Figure 3:
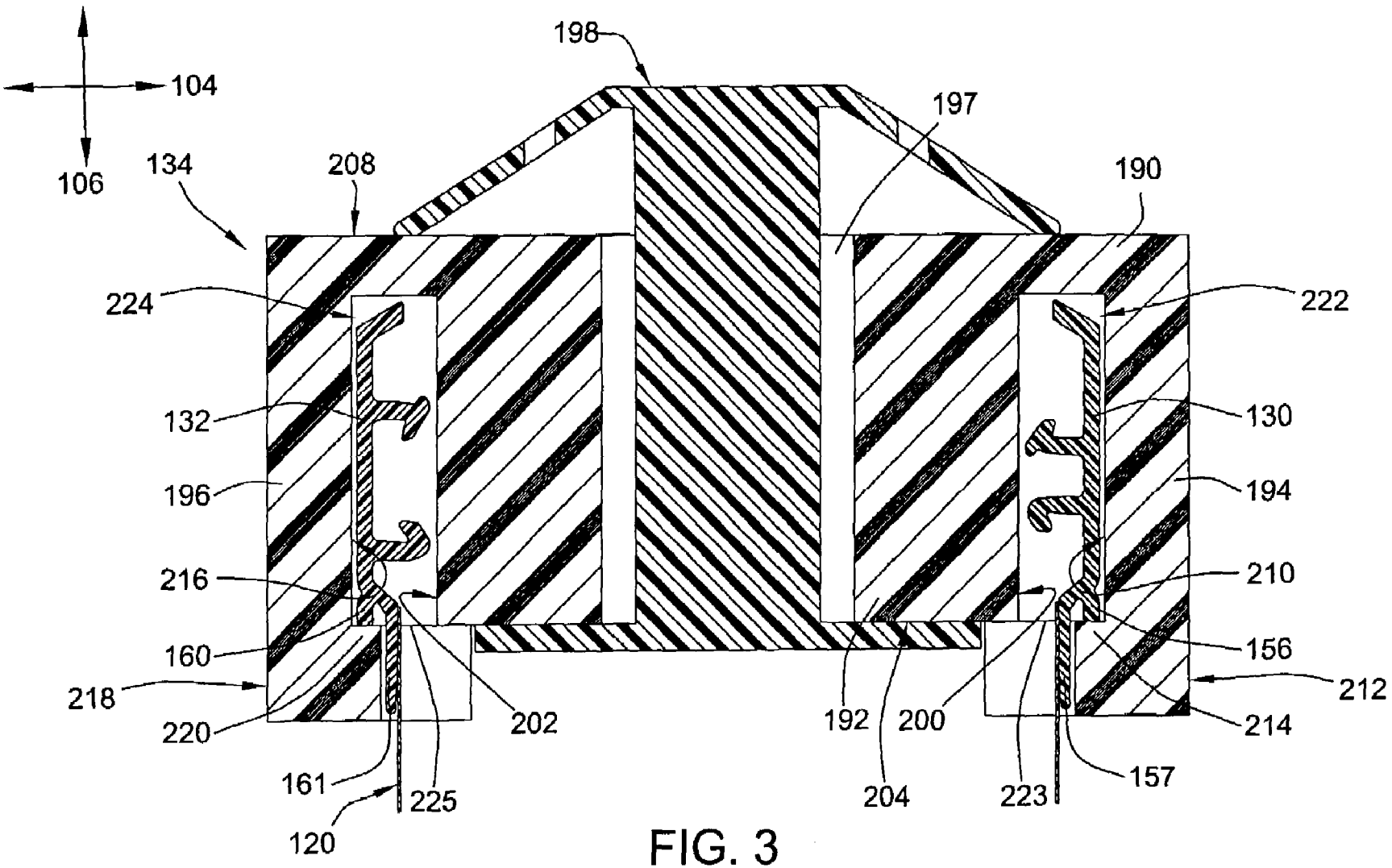
FIG. 3 is a partial cross-sectional view of the container taken along line 3-3 in FIG. 1.

Referring to FIG. 3, the slider 134 includes a top portion 190, a separator 192, a first side wall 194, a second side wall 196, an opening 197, and a valve 198. When the slider 134 is moved in the deocclusion direction, the separator 192 deocludes the fastening strips 130, 132. The side walls 194, 196 depend from the top portion 190 and are in spaced relation to the separator 192 and to each other. The valve 198 is movably disposed in the opening 197.

The separator 192 depends from the top portion 190 and includes a first side surface 200, a second side surface 202, and a bottom surface 204. The opening 197 extends between a top surface 208 of the top portion 190 and the bottom surface 204 of the separator 192.

The first side wall 194 includes an inner surface 210, an outer surface 212, and a shoulder 214. The inner surface 210 of the first side wall 194 is generally parallel to the first side surface 200 of the separator 192 along the Z axis 106. The shoulder 214 depends from the first side wall 194 and inwardly extends a predetermined distance toward the opening 197. Likewise, the second side wall 196 includes an inner surface 216, an outer surface 218, and a shoulder 220. The inner surface 216 of the second side wall 196 is generally parallel to the second side surface 202 of the separator 192 along the Z axis 106. The shoulder 220 depends from the second side wall 196 and inwardly extends a predetermined distance toward the opening 197.

A first passage 222 is bounded by: the first side surface 200; the top portion 190 of the separator 192; the inner surface 210; and the shoulder 214 of the first side wall 194. The first passage 222 includes an opening 223 that extends the length of the passage 222 along the X axis 102. The first fastening strip 130 extends through the first passage 222 along the X axis 102. The flange portion 157 of the first fastening strip 130 extends through the opening 223 of the first passage 222 along the Z axis 106. The rib 156 of the first fastening strip 130 and the shoulder 214 of the slider 134 are in retentively locking relation to provide a mechanical connection between the bag 120 and the slider 134 that prevents the slider 134 from moving relative to the bag 120 upward in the Z axis 106.

The height of the first passage 222, measured along the Z axis 106, can be configured such that it closely conforms to the height of the first fastening strip 130, also measured along the Z axis 106. In other embodiments, the height of the first passage 222 can be less than the height of the first fastening strip 130 such that the rib 156 and the flange 154 of the first fastening strip 130 are in contacting relation with the slider 134 to provide a seal, while still allowing the slider 134 to move relative to the fastening strips 130, 132 along the X axis 102.

Similarly, a second passage 224 is bounded by: the second side surface 202; the top portion 190 of the separator 192; the inner surface 216; and the shoulder 220 of the second side wall 196. The second passage 224 includes an opening 225 that extends the length of the passage 224 along the X axis 102. The second fastening strip 132 extends through the second passage 224 along the X axis 102. The flange portion 161 of the second fastening strip 132 extends through the opening 225 of the second passage 224 along the Z axis 106. The rib 160 of the second fastening strip 132 and the shoulder 220 are in retentively locking relation to provide a mechanical connection between the bag 120 and the slider 134 that prevents the slider 134 from moving relative to the bag 120 upward in the Z axis 106.

The height of the second passage 224, measured along the Z axis 106, can be configured such that it closely conforms to the height of the second fastening strip 132, also measured along the Z axis 106. In other embodiments, the height of the second passage 224 can be less than the height of the second fastening strip 132 such that the rib 160 and the flange 158 of the second fastening strip 132 are in contacting relation with the slider 134 to provide a seal, while still allowing the slider 134 to move relative to the fastening strips 130, 132 along the X axis 102.

Figure 4:
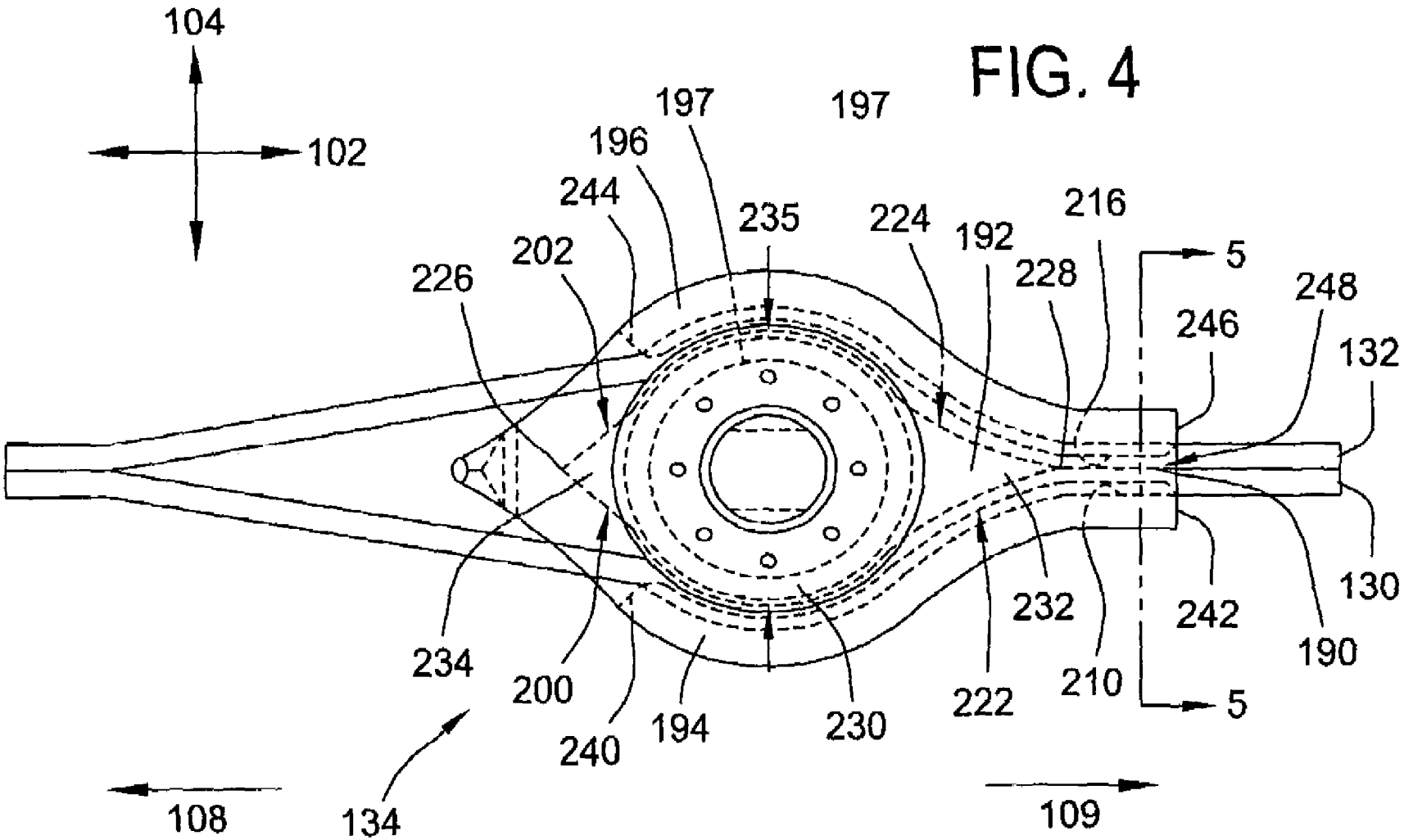
FIG. 4 is a fragmentary top plan view of the container in FIG. 1.

Referring to FIG. 4, the first and the second side surfaces 200, 202 of the separator 192 are mirror images of each other about the X axis 102 and converge to meet at a first edge 226 and a second edge 228. The separator 192 includes a body portion 230, a wedge portion 232, and a tapered plug portion 234. The body 230 is disposed along the X axis 102 between the wedge 232 and the tapered plug 234. The first and second side surfaces 200, 202 are curved outward at the intermediate body 230 and are disposed a maximum distance 235 away from each other along the Y axis 104 at the body 230. The body 230 is generally circular and is configured to accommodate the opening 197. The wedge 232 extends from the body 230 in the deocclusion direction 109. The wedge 232 is generally V-shaped and terminates at the second edge 228. The tapered plug 234 extends from the body 230 in the occlusion direction 108. The tapered plug is generally V-shaped and terminates at the first edge 226.

The first side wall 194 of the slider 134 has a first end 240 and a second end 242. The second side wall 196 of the slider 134 also has a first end 244 and a second end 246. The first ends 240, 244 of the side walls 194, 196 oppose each other and can be disposed along the X axis 102 between the first edge 226 and the opening 197 of the separator 192. The second ends 242, 246 of the side walls 194, 196 oppose each other and can be disposed along the X axis 102 a predetermined distance from the second edge 228 of the separator 192 in the deocclusion direction 109.

The first passage 222 extends along the X axis 102 between the first end 240 of the first side wall 194 and the second edge 228 of the separator 192. The second passage 224 extends between the first end 244 of the second side wall 196 and the second edge 228 of the separator 192. At the second edge 228 of the separator 192, the first passage 222 and the second passage 224 converge to provide an occlusion passage 248. The first fastening strip 130 extends along the X axis 102 through the first passage 222 and the occlusion passage 248. The second fastening strip 132 extends along the X axis 102 through the second passage 224 and the occlusion passage 248.

Figure 5:
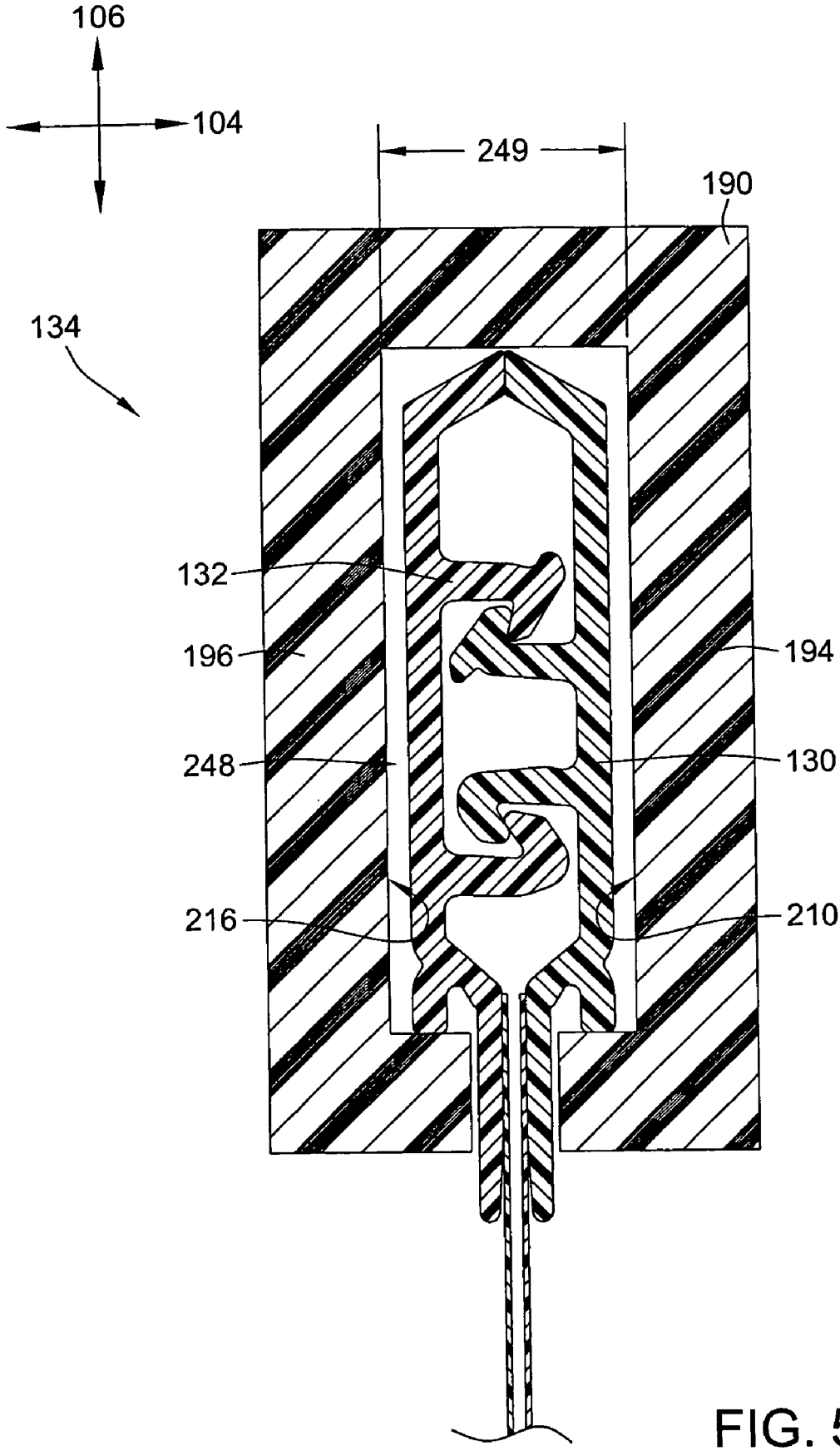
FIG. 5 is a partial cross-sectional view of the container taken along line 5-5 in FIG. 1.

Referring to FIG. 5, the occlusion passage 248 is formed by the inner surface 210 of the first side wall 194, the inner surface 216 of the second side wall 196, and the top portion 190 of the slider 134. The inner surfaces 210, 216 of the side walls 194, 196 define a width 249 of the occlusion passage 248. The occlusion passage 248, is configured to occlude the fastening strips 130, 132 as the slider 134 is moved in the occlusion direction. The width 249 of the occlusion passage 248, measured along the Y axis 104, is configured such that when the strips are occluded, the occlusion passage 248 accommodates the fastening strips 130, 132 to allow the fastening strips to pass through the occlusion passage 248, and when the strips are deoccluded, the occlusion passage 248 interferingly engages the fastening strips 130, 132 to interlock the fastening strips 130, 132. As the slider 134 moves in the occlusion direction, the occlusion passage 248 interferingly engages the fastening strips 130, 132 to occlude the fastening strips 130, 132.

Referring to FIG. 4, with respect to a point along the X axis 102 of the fastening strips 130, 132, when the slider moves in the deocclusion direction 109, the occlusion passage 248 accommodates the occluded fastening strips 130, 132. As the fastening strips 130, 132 pass the second edge 228 of the separator 192, the separator 192 divides the fastening strips 130, 132. The first and the second fastening strips 130, 132 enter the first and the second passages 222, 224, respectively. As the fastening strips 130, 132 pass the first ends 240, 244 of the side walls 194, 196, respectively, the fastening strips 130, 132 exit the slider 134 and remain deoccluded.

Figure 6:
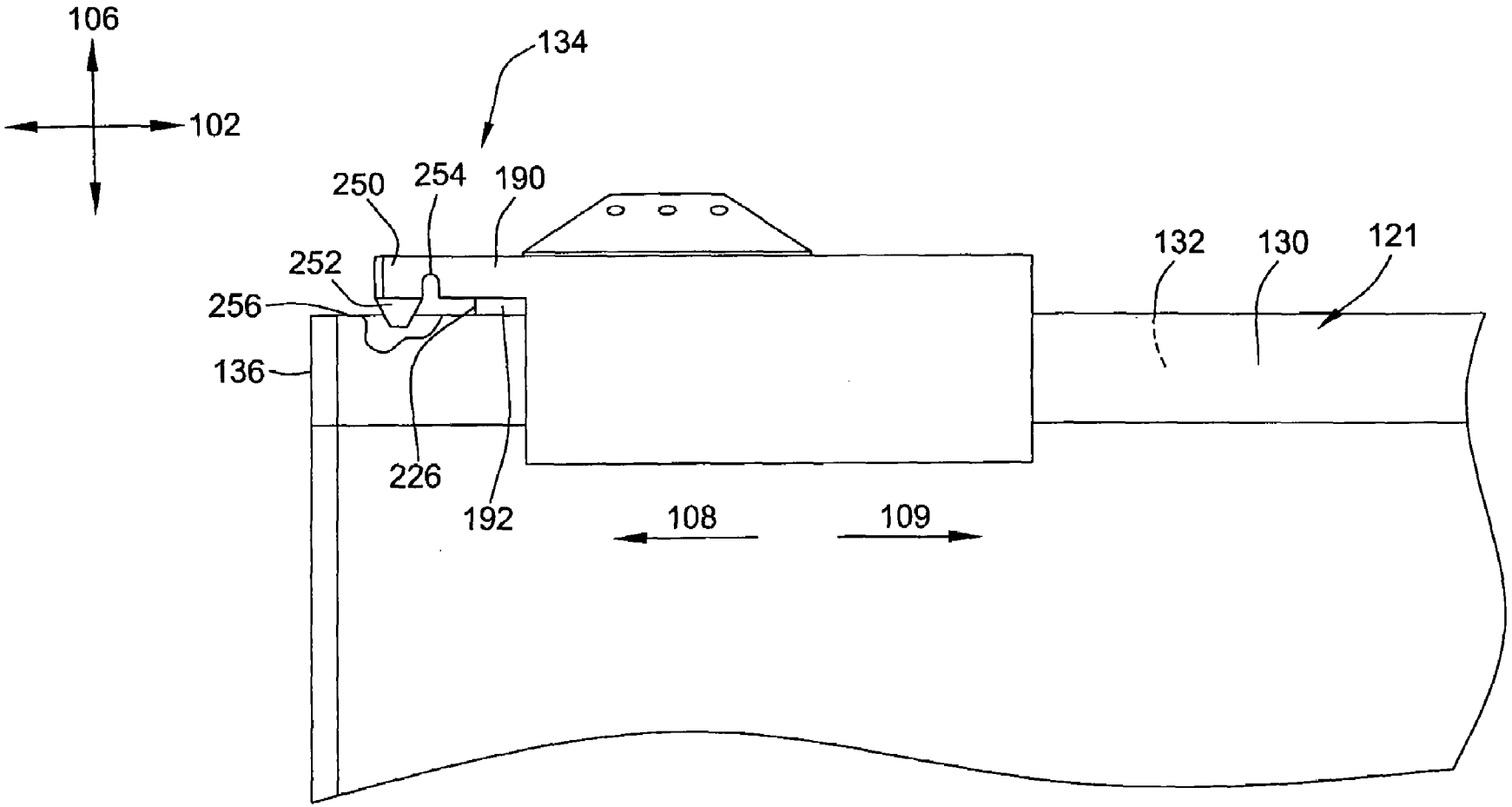
FIG. 6 is a fragmentary side elevational view of the container in FIG. 1.
Figure 7:
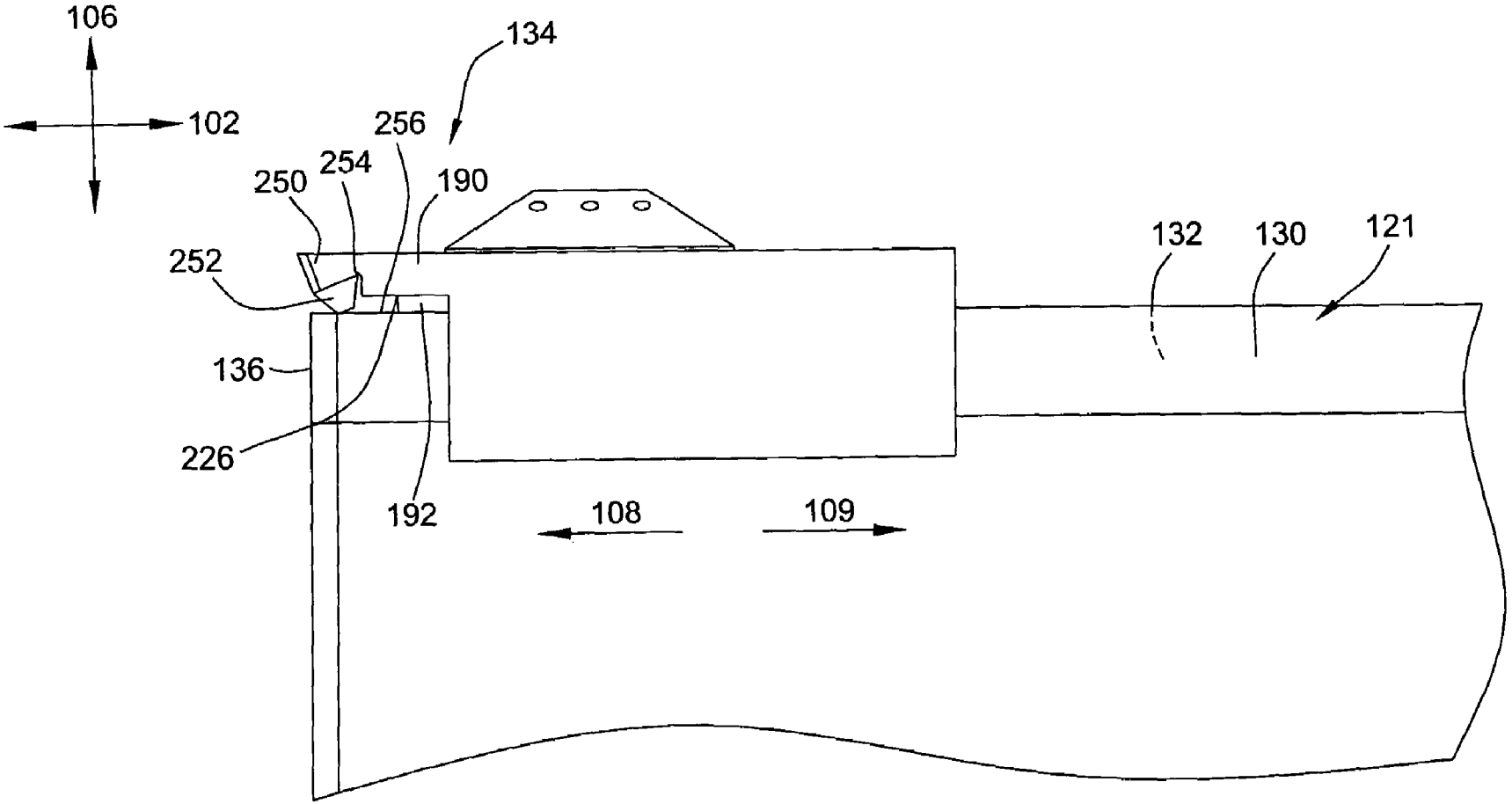
FIG. 7 is a fragmentary side elevational view of the container in FIG. 1.
Figure 8:
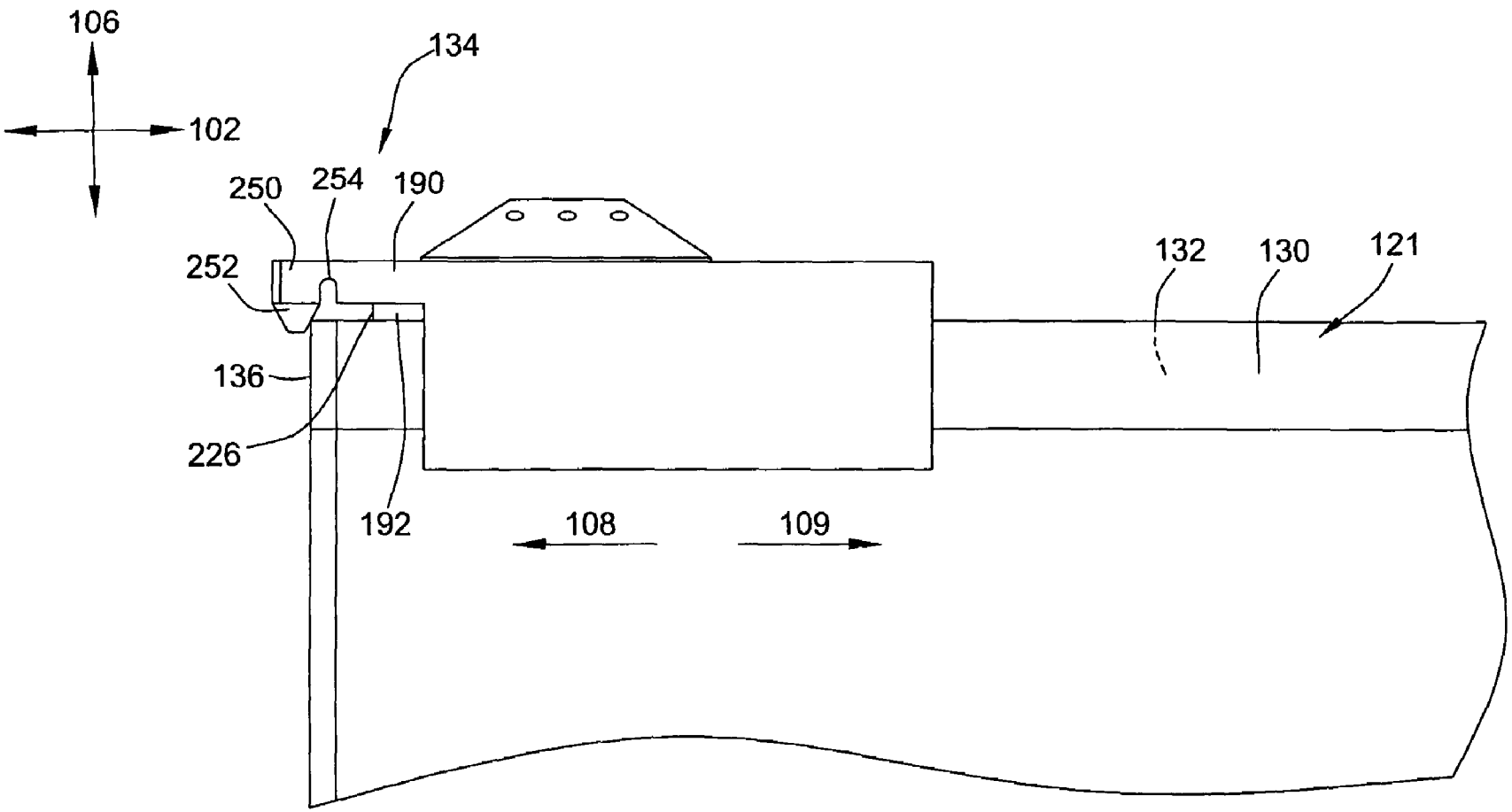
FIG. 8 is a fragmentary side elevational view of the container in FIG. 1.

Referring to FIGS. 6, 7, and 8, the slider 134 can include a nose portion 250 for latching the slider 134 in a "parked" or a latched position. The nose portion 250 extends from the top portion 190 in the occlusion direction 108 beyond the first edge 226 of the separator 192. A catch 252 depends from the nose portion 250. The nose portion 250 also includes a notch 254.

Referring to FIG. 6, the slider 134 is positioned near the first end 136 of the closure device 121. The catch 252 is configured to extend just below a top edge 256 of the closure device 121. When the catch 252 of the slider 134 is between the ends 136, 138 of the closure device 121, the catch 252 can move freely along the X axis 102 without contacting the fastening strips 130, 132 as shown in FIG. 4. Specifically, the catch 252 is disposed between the deoccluded fastening strips 130, 132 as shown in FIG. 4.

Referring to FIG. 7, the catch 252 interferes with the first end 136 of the closure device 121 as the slider 134 moves in the occlusion direction 108 toward the first end 136 of the closure device 121. Upon further movement of the slider 134 in the occlusion direction 108, the notch 254 permits the nose portion 250 to bend. The nose portion 250 is configured to be sufficiently flexible such that the catch 252 can move above the top edge 256 of the closure device 121 in the Z axis 106 to allow the catch 252 to move past the first end 136 in the X axis 102.

FIG. 8 shows the nose portion 250 after it has been moved in the occlusion direction 108 beyond the first end 136 of the closure device 121. The catch 252 extends below the top edge 256 of the closure device 121. The slider 134 remains in the latched position until a release force sufficient to allow the nose portion 250 to move past the first end 136 is applied to the slider 134 in the deocclusion direction 109. Because the slider 134 will not move unless a release force sufficient to deflect the nose portion 250 is applied, the slider 134 will not inadvertently deocclude the fastening strips 130, 132.

Figure 9:
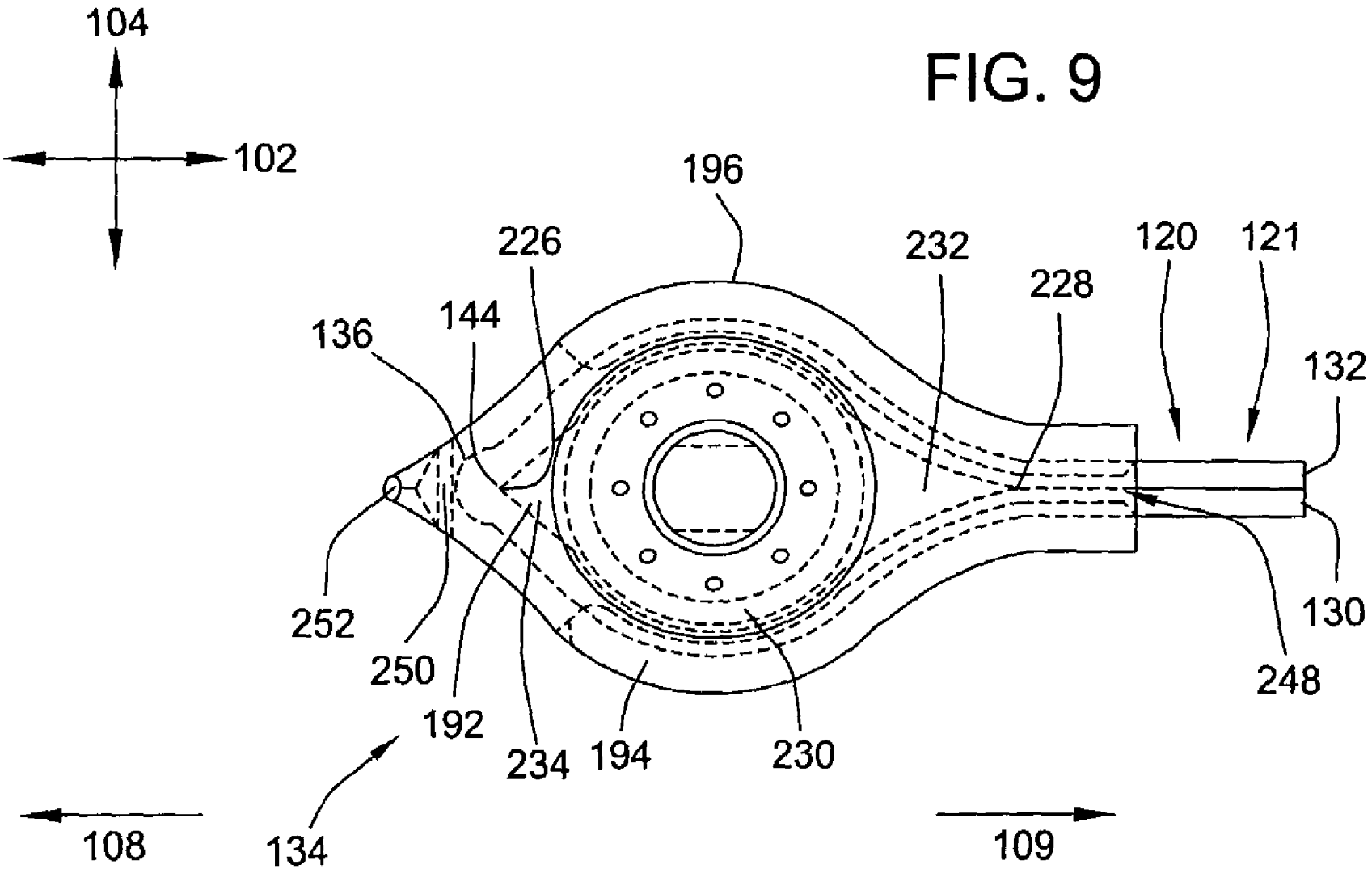
FIG. 9 is a fragmentary top plan view of the container in FIG. 1.

Referring to FIG. 9, the slider 134 is in a latched position. The first edge 226 of the separator 192 abuts the first end stop 144 formed at the first end 136 of the closure device 121. The tapered plug 234 of the separator 192 is in contacting relation with the first and second fastening strips 130, 132 to provide a seal. The flexible fastening strips 130, 132 follow the divergent sides of the tapered plug 234 and wrap around the body 230 of the separator 192, conforming to the shape of the separator 192. The side walls 194, 196 of the slider 134 urge the fastening strips 130, 132 to follow the shape of the wedge 232 of the separator 192. The fastening strips 130, 132 converge from the body 230 to the second edge 228 of the separator 192 where they meet to occlude in the occlusion passage 248.

In the latched position, the slider 134 is in operative engagement with the fastening strips 130, 132 to provide a seal that fully closes the bag 120. The nose portion 250 and catch 252 extend beyond the first end 136 of the closure device 121 and cause the slider 134 to be retained in a latched position, further ensuring that the seal between the fastening strips 130, 132 and the separator 192 is maintained.

Figure 10:
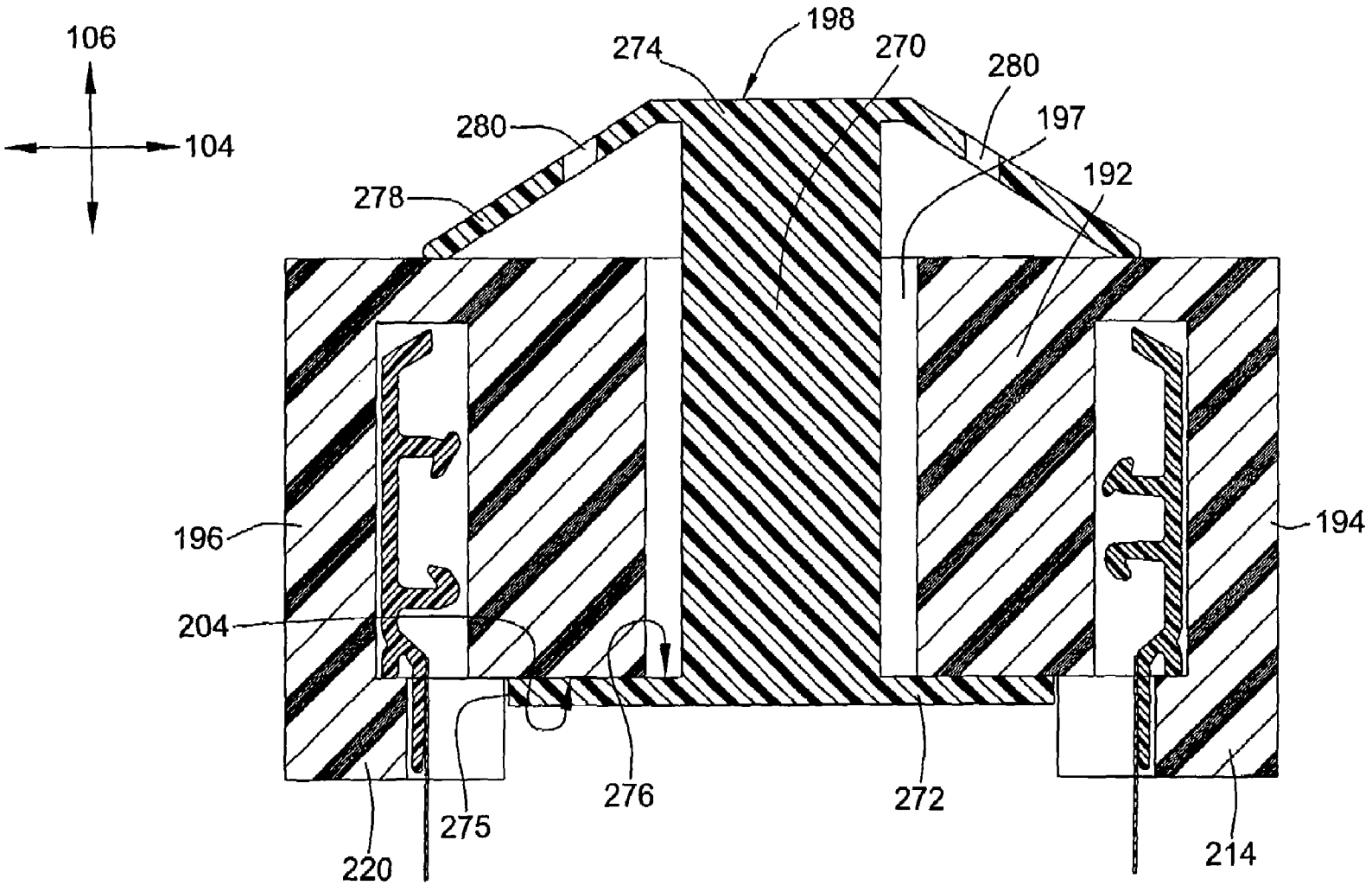
FIG. 10 is a partial cross-sectional view of the container as in FIG. 3.
Figure 11:
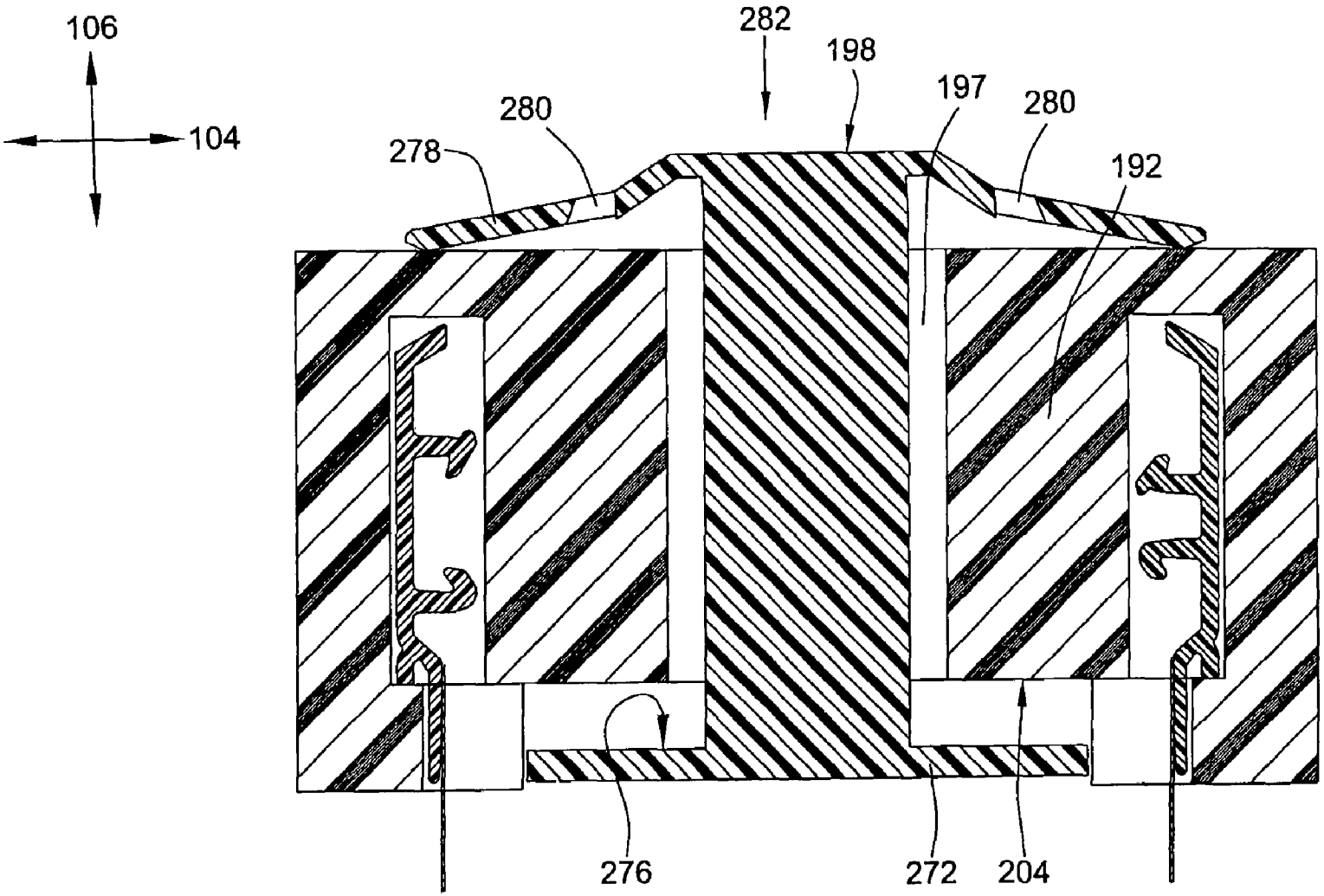
FIG. 11 is a partial cross-sectional view of the container as in FIG. 10.

FIGS. 10 and 11 illustrate the operation of the valve 198. Turning to FIG. 10, the valve 198 includes a stem 270, a head 272, and a flange portion 274. The stem 270 can be generally cylindrical in shape and configured to move in the vertical Z axis 106 within the opening 197. The head 272 is disposed at the lower end of the stem 270 and is generally disk-shaped. The size of the head 272 is configured to be greater than the size of the opening 197 such that the head 272 cannot move through the opening 197. A perimeter 275 of the head 272 of the valve 198 is configured to be spaced apart a predetermined distance from the shoulders 214, 220 of the side walls 194, 196. A mating surface 276 of the valve 198 is configured to mate with the bottom surface 204 of the separator 192. Though this embodiment illustrates a flat mating surface 276, other embodiments may include a mating surface that is beveled or ridged.

The flange portion 274 of the valve 198 is disposed at the upper end of the stem 270. The flange portion 274 includes a resiliently flexible skirt 278 perforated with a plurality of vent holes 280. When the skirt 278 is in a normal position, the skirt 278 extends at a downward angle from the flange portion 274. The skirt 278 biases the valve 198 to a closed position wherein the mating surface 276 of the head 272 is urged against the bottom surface 204 of the separator 192 to provide a seal. The valve 198 can be disposed within the opening 197 by inserting the valve 198 into the bottom of the opening 197. As the valve 198 is inserted, the skirt 278 collapses to fit with the opening 197. The valve 198 is inserted until the skirt 278 extends past the top of the opening 197 and the skirt 278 is able to open from its collapsed position. The valve 198 then assumes the position shown in FIG. 10.

Referring to FIG. 11, the valve 198 can be opened by applying a release force in a release direction 282 along the vertical Z axis 106 upon the valve 198. The force is sufficient to overcome the biasing force provided by the skirt 278. Upon application of such a downward force, the skirt 278 can move to a flexed position which allows the head 272 of the valve 198 to move away from the bottom surface 204 of the separator 192, as shown in FIG. 11. With the head 272 of the valve 198 disengaged from the bottom surface 204 of the separator 192, matter is free to flow past the head 272, through the opening 197 and out the vent holes 280 of the skirt 278. Matter can also flow in the opposite direction. Once the release force is removed, the skirt 278 biases the valve 198 to the closed position, moving the head 272 of the valve 198 toward the bottom surface 204 of the separator 192 until the mating surface 276 of the head 272 engages the bottom surface 204. In other embodiments, other types of valves, such as, needle valves, ball valves, duckbill valves or other mechanical valves may be used.

Figure 12:
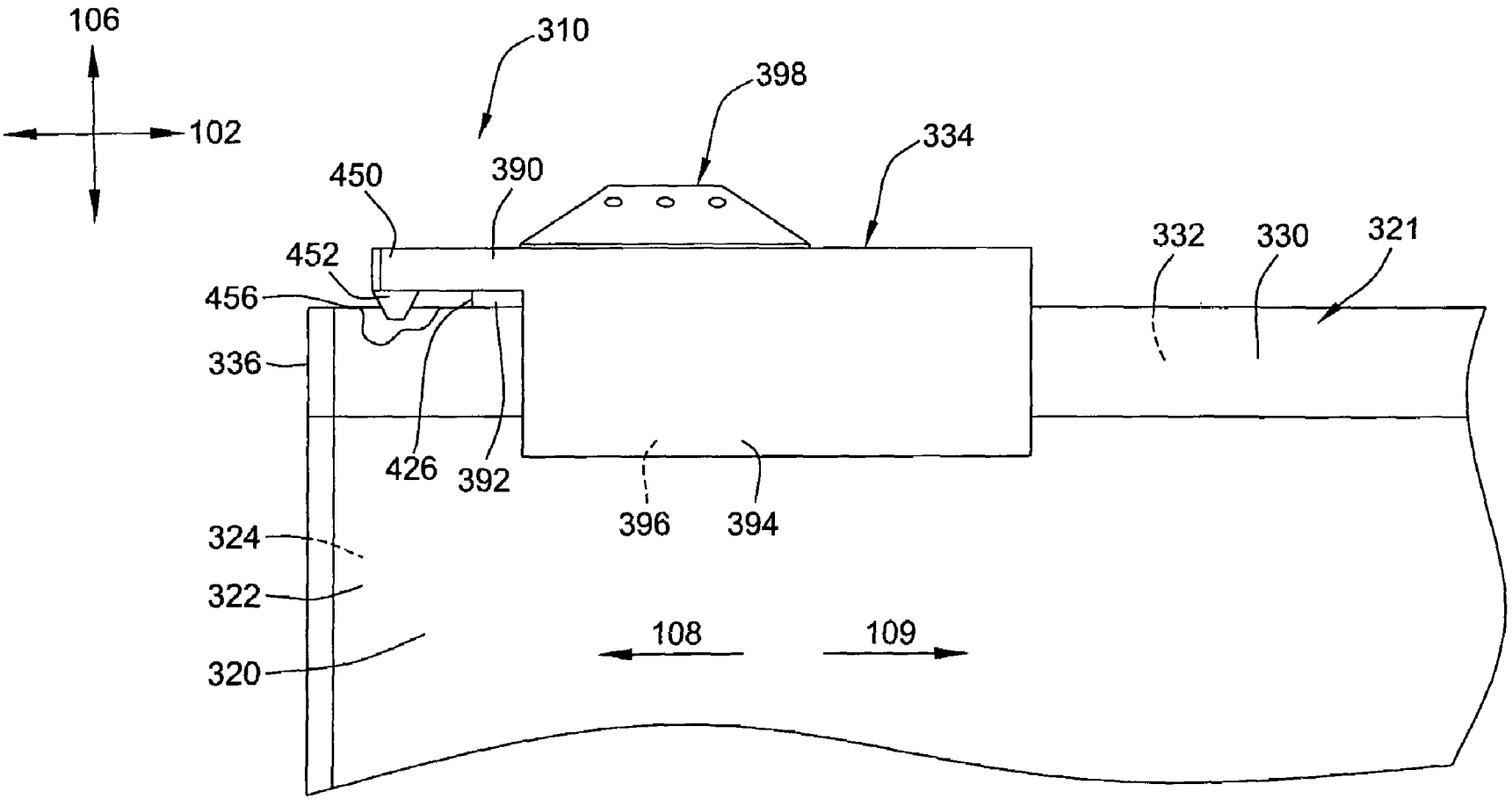
FIG. 12 is a fragmentary side elevational view of another embodiment of a container.
Figure 13:
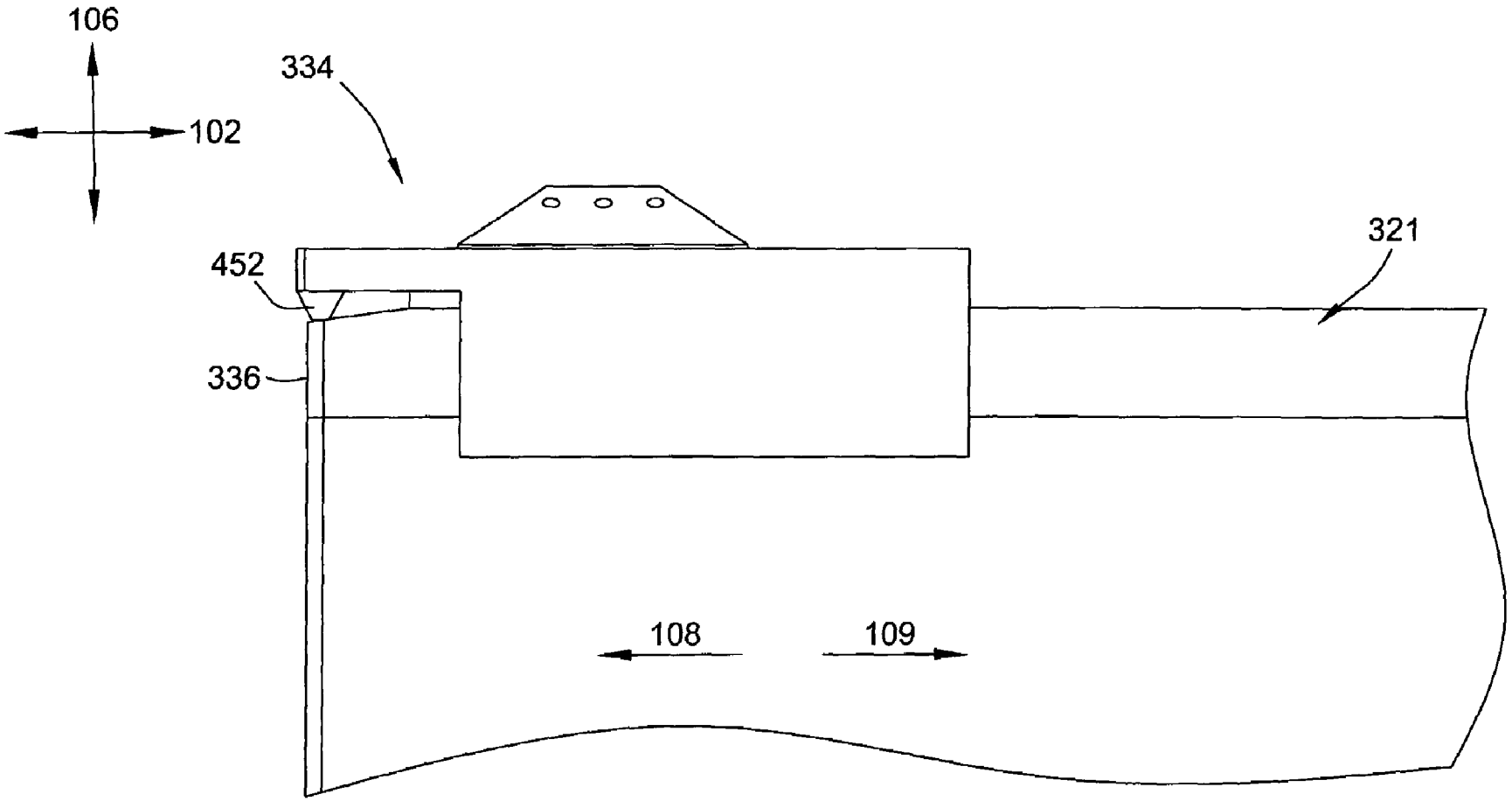
FIG. 13 is a fragmentary side elevational view of the container in FIG. 12.
Figure 14:
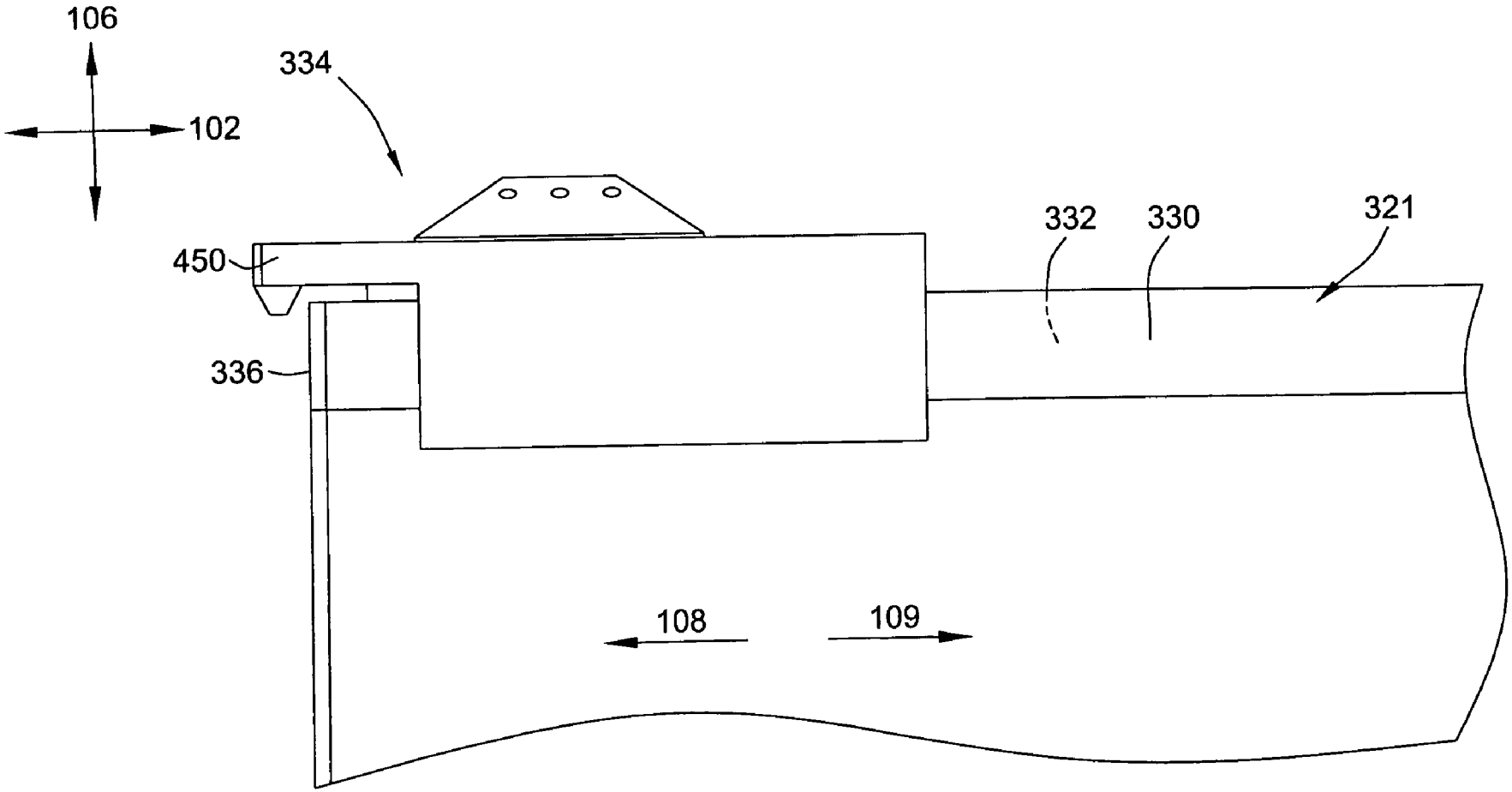
FIG. 14 is a fragmentary side elevational view of the container in FIG. 12.

Referring to FIGS. 12-14, another embodiment of a nose portion for latching the slider in a latched position is shown. As shown in FIG. 12, A container 310 is in the form of a plastic bag 320 having a closure device 321. The bag 320 includes a first side wall 322 and a second side wall 324 joined at a pair of seams. The closure device 321 includes a first fastening strip 330, a second fastening strip 332, and a slider 334. The slider 334 is mounted onto the fastening strips 330, 332 so that the slider 334 is restrained from being removed from the fastening strips 330, 332 in the Z axis 106 but free to slide along the X axis 102. The slider 334 includes a top portion 390, a separator 392, a pair of side walls 394, 396, an opening, and a valve 398. The separator 392 depends from the top portion 390. The side walls 394, 396 also depend from the top portion 390 and generally are in spaced relation to the separator 392 and to each other. The valve 398 is movably disposed in the opening.

The slider 334 includes a nose portion 450 for latching the slider 334 in a latched position. The nose portion 450 extends from the top portion 390 in an occlusion direction 108 along the X axis 102 beyond a first edge 426 of the separator 392. A catch 452 depends from the nose portion 450. The nose portion 450 is configured to be rigid relative to a first end 336 of the closure device 321.

In FIG. 12, the slider 334 is positioned near the first end 336 of the closure device 321. The catch 452 is configure to extend just below an upper edge 456 of the closure device 321. When the catch 452 of the slider 334 is between the ends 336, 338 of the closure device 321, the catch 452 can move freely along the X axis without contacting the fastening strips 330, 332, the catch 452 being disposed between the deoccluded fastening strips 330, 332. As the slider 334 is moved along the length of the closure device 321, the catch 452 slides freely between the fastening strips 330, 332.

Referring to FIG. 13, the catch 452 interferes with the first end 336 of the closure device 321 as the slider 334 moves in the occlusion direction 108. Continued movement of the slider 334 in the occlusion direction 108 causes the first end 336 of the closure device 321 to deflect. The first end 336 is configured to be sufficiently flexible such that the first end 336 deflects downward in the Z axis 106 to allow the catch 452 to move past the first end 336. The first end 336 of the closure device can be made flexible by using a flexible material in its construction, cutting a small slit in the top of the seam, or other means.

FIG. 14 shows the nose portion 450 after it has moved in the occlusion direction 108 beyond the first end 336 of the closure device 321. The slider 334 remains in the latched position until a release force sufficient to allow the nose portion 450 to move past the first end 336 is applied to the slider 334 in the deocclusion direction 109. Because the slider 334 will not move unless a release force sufficient to deflect the first end 336 is applied, the slider 334 will not inadvertently deocclude the fastening strips 330, 332. The slider 334 is similar in other respects to the slider 134 as shown in FIGS. 1-11 and herein described.

Figure 15:
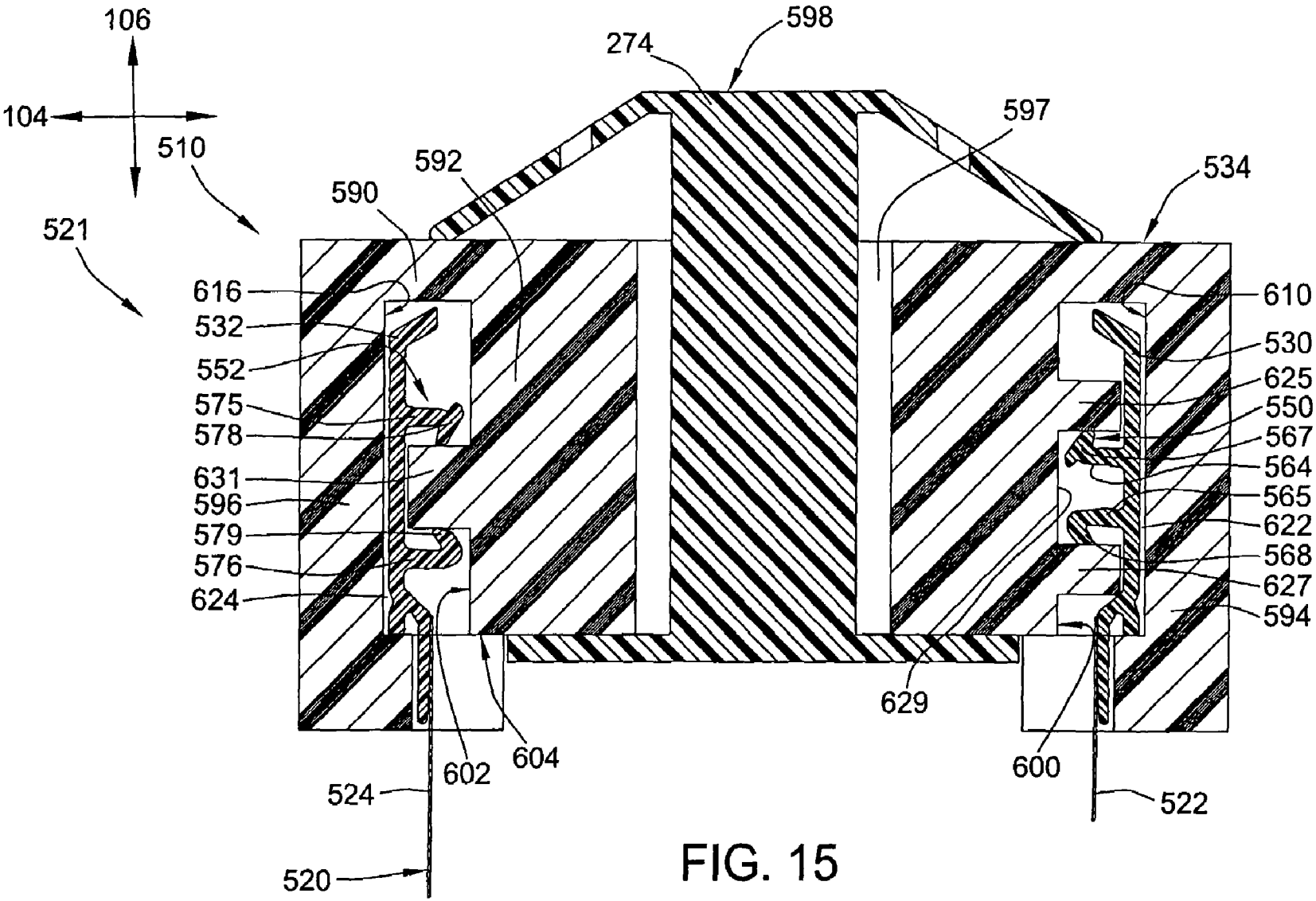
FIG. 15 is a partial cross-sectional view of another embodiment of a container.

In accordance with another aspect of the invention, FIG. 15 shows an embodiment of a separator with side surfaces which engage respective closure elements to provide a seal between the closure elements and the separator. In addition, the side surfaces of the separator may provide support in the Z axis 106 for the fastening strips. A container 510 is in the form of a plastic bag 520 having a sealable closure device 521. The bag 520 includes a first side wall 522 and a second side wall 524. The closure device includes a first fastening strip 530, a second fastening strip 532, and a slider 534. The first fastening strip 530 includes a first closure element 550 and the second fastening strip 532 includes a second closure element 552. The first closure element 550 can engage the second closure element 552 to occlude the fastening strips 530, 532.

The slider 534 includes a top portion 590, a separator 592, a first side wall 594, a second side wall 596, an opening 597, and a valve 598. The separator 592 depends from the top portion 590 and divides the fastening strips 530, 532. The separator includes a first side surface 600, a second side surface 602, and a bottom surface 604. The side walls 594, 596 also depend from the top portion and are in spaced relation to the side surfaces 600, 602 of the separator 592 and to each other. The valve 598 is movably disposed within the opening 597.

The top portion 590, the separator 592, and the first side wall 594 create a first passage 622. The top portion 590, the separator 592, and the second side wall 596 create a second passage 624. The first and second passages 622, 624 are configured to sealingly engage the first and second fastening strips 530, 532, respectively. More specifically, the first and second side surfaces 600, 602 of the separator 592 conform to the first and the second closure elements 550, 552, respectively, to provide a seal. In addition, the passages 622, 624 may provide support for the fastening strips 530, 532.

A first side surface 600 of the separator 592 has a profile that includes an upper rib 625 and a lower rib 627 that form a channel 629. The upper and lower ribs 625, 627 extend substantially the entire length of the separator 592, measured along the X axis 102. A second side surface 602 of the separator 592 has a profile that includes a key 631. The slider 534 is similar in other respects to the slider 134 as shown in FIGS. 1-11 and herein described.

The first fastening strip 530 extends through the first passage 622 and the second fastening strip 532 extends through the second passage 624. The first and the second fastening strips 530, 532 shown in FIG. 15 are similar to the first and the second fastening strips 130, 132, respectively, as shown in FIGS. 1-11 and herein described. The first fastening strip 530 includes a pair of parallely disposed upper and lower webs 564, 565, respectively. The upper and lower webs 564, 565 form the U-channel closure element 550. The closure element 550 is disposed within the channel 629 of the slider 534. A hook closure portion 567 of the upper web 564 is in contact with the upper rib 625. Likewise, a hook closure portion 568 of the lower web 565 is in contact with the lower rib 627. The contacting relationship between the upper and lower webs 164, 165 of the first fastening strip 530 and the upper and lower ribs 625, 627 of the slider 534, respectively, serve to provide an additional seal.

The second fastening strip 532 includes a pair of parallely disposed upper and lower webs 575, 576, respectively. The upper and lower webs 575, 576 form the U-channel closure element 552. A hook closure portion 578 of the upper web 575 is in contact with the key 631. Likewise, a hook closure portion 579 of the lower web 576 is also in contact with the key 631. The contacting relationship between the webs 575, 576 and the key 631 serve to provide an additional seal.

Figure 16:
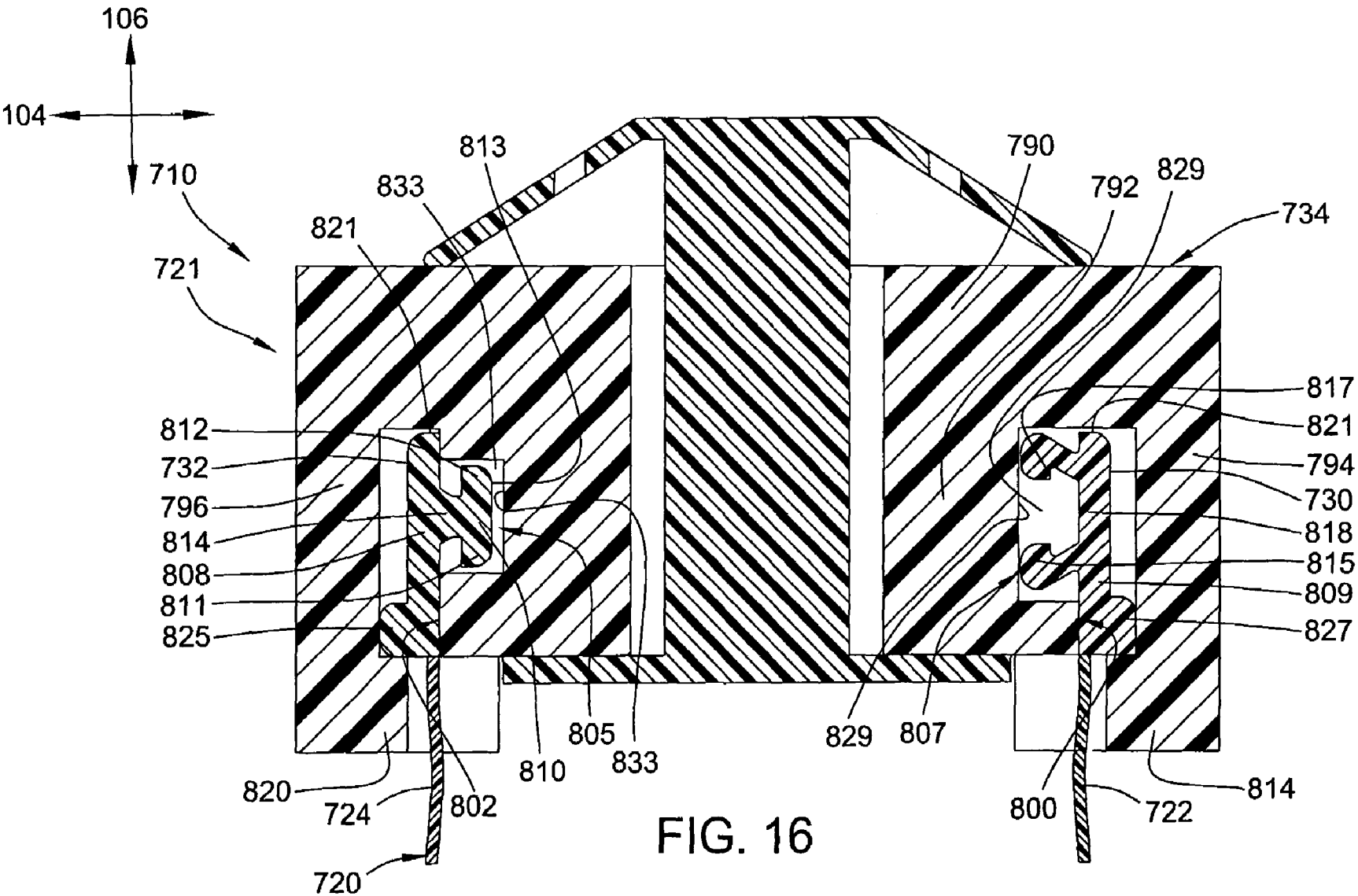
FIG. 16 is a partial cross-sectional view of another embodiment of a container.
Figure 17:
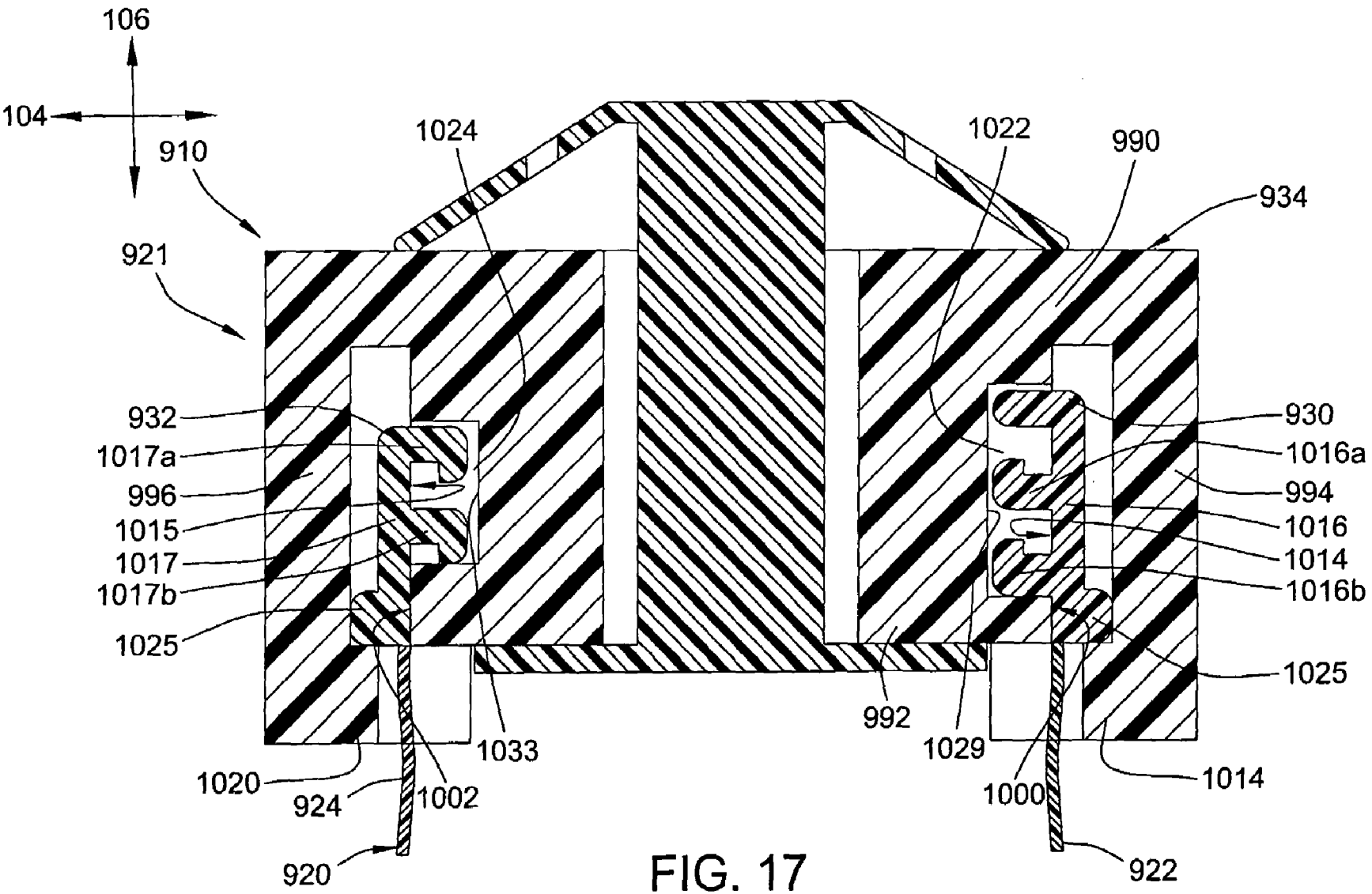
FIG. 17 is a partial cross-sectional view of another embodiment of a container.
Figure 18:
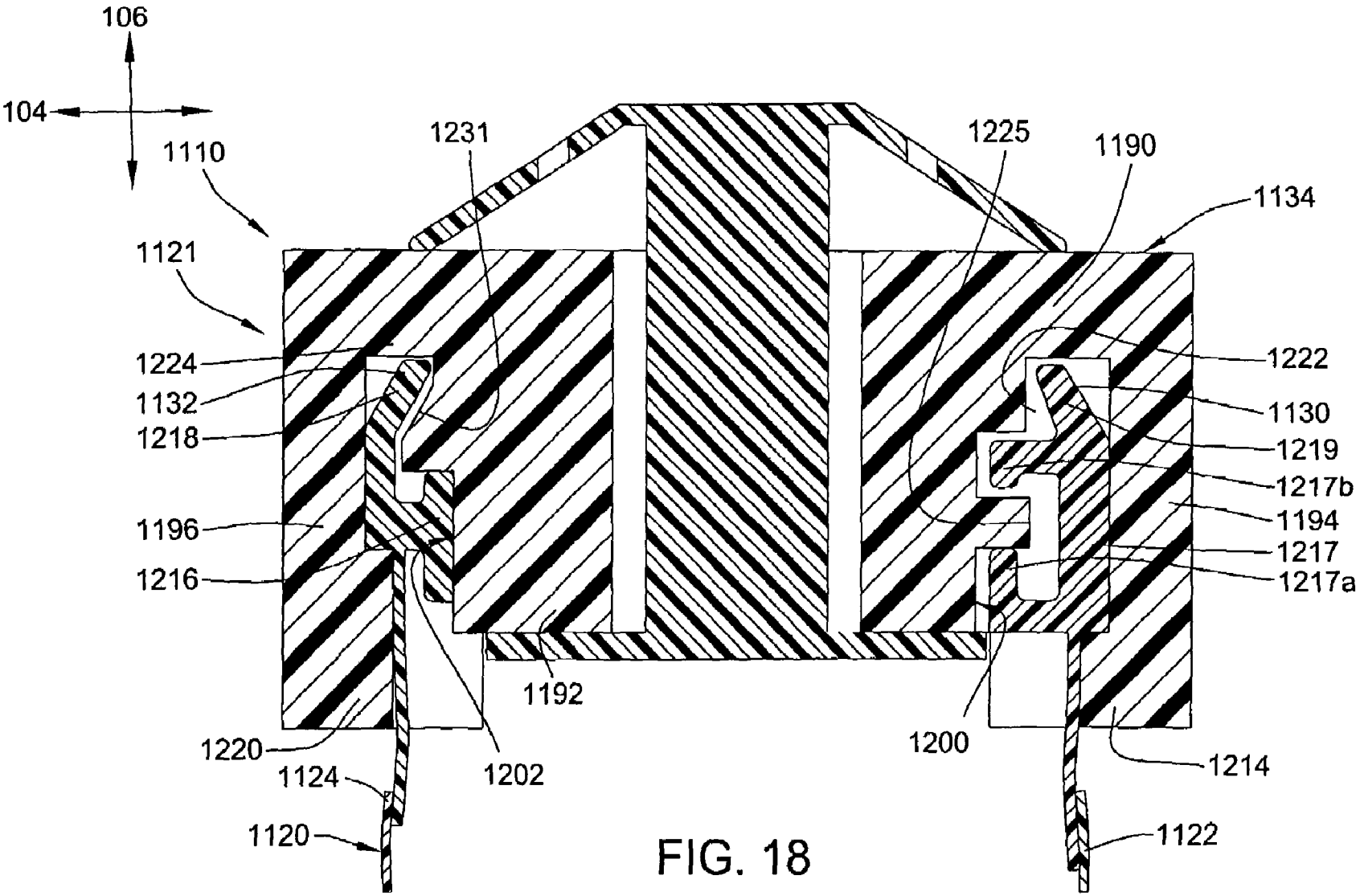
FIG. 18 is a partial cross-sectional view of another embodiment of a container.

In keeping with a general aspect of the present invention and as will be described in greater detail below, the interlocking fastening strips may be of a different type or form, as shown in FIGS. 16-18.

In accordance with another aspect of the present invention, FIG. 16 shows another embodiment which shows another type of fastening strips. A container 710 is in the form of a plastic bag 720 having a sealable closure device 721. The bag 720 includes a first side wall 722 and a second side wall 724. The closure device 721 includes a first fastening strip 730, a second fastening strip 732, and a slider 734.

The fastening strips 730, 732 are "arrowhead-type" or "rib and groove" fastening strips as described in U.S. Pat. No. 3,806,998. A rib element 805 interlocks with a groove element 807. The rib element 805 is of generally arrow-shape in transverse cross section including a head 810 comprising interlock shoulder hook portions 811 and 812 generally convergently related to provide a cam ridge 813 generally aligned with a stem flange 814 by which the head is connected in spaced relation with respect to a supporting flange portion 808. (U.S. Pat. No. 3,806,998, Col. 2, lines 16-23). At their surfaces nearest the connecting stem flange 814, the shoulder portions 811 and 812 define reentrant angles therewith providing interlock hooks engageable with interlock hook flanges 815 and 817, respectively, of the groove element 807. (U.S. Pat. No. 3,806,998, Col. 2, lines 23-28). Said hook flanges generally converge toward one another and are spread open to receive the head 810 therebetween when said head is pressed into said groove element 807 until the head is fully received in a groove 818 of said groove element 807 generally complementary to the head and within which the head is interlocked by interengagement of the head shoulder hook portions 811 and 812 and the groove hook flanges 815 and 817. (U.S. Pat. No. 3,806,998, Col. 2, lines 28-36). Through this arrangement, as indicated, the head and groove elements 805 and 807 are adapted to be interlockingly engaged by being pressed together and to be separated when forcibly pulled apart, as by means of the slider 734. (U.S. Pat. No. 3,806,998, Col. 2, lines 36-41).

The slider 734 includes a top portion 790 adapted to run along free edges 821 on the upper ends of the sections of the flange portions 808 and 809 as shown in the drawing. Integrally formed with the top portion 790 and depending therefrom are coextensive side walls 794, 796. The side walls 794, 796 are each provided with an inwardly projecting shoulder 814, 820 adapted to engage respective shoulder ribs 825 and 827 on respectively outer sides of the lower section of the flange portions 808 and 809.

The slider 734 has a separator 792 that depends from the top portion 790 and is disposed between the side walls 794, 796. The separator 792 has a first side surface 800 and a second side surface 802. The side surfaces 800, 802 engage the first and second fastening strips 730, 732 to provide a seal between the slider 734 and the first and second fastening strips 730, 732.

Specifically, the first side surface 800 of the separator 792 has a profile that includes a recess 829 configured to receive the groove element 807 of the first fastening strip 730. The side surface 800 engages the groove element 807 to provide a seal between the groove element 807 and the separator 792. The recess 829 conforms generally to the shape of the groove element 807 of the fastening strip 730. In addition, the side surface 800 may provide support for the fastening strips 730, 732.

The second side surface 802 of the separator 792 has a profile that includes a groove 833 configured to receive the rib element 805 of the second fastening strip 732 and to provide a seal between the slider 734 and the second fastening strip 732. The groove 833 conforms generally to the shape of the rib element 805. The side surface 802 engages the rib element 805 to provide a seal between the rib element 805 and the separator 792. In addition, the side surface 802 may provide support for the fastening strip. The slider 734 is similar in other respects to the slider 134 as shown in FIGS. 1-11 and herein described.

FIG. 17 shows another embodiment which shows another type of fastening strips. A container 910 is in the form of a plastic bag 920 having a sealable closure device 921. The bag 920 includes a first side wall 922 and a second side wall 924. The closure device 921 includes a first fastening strip 930, a second fastening strip 932, and a slider 934.

The fastening strips 930, 932 are "profile" fastening strips as described in U.S. Pat. No. 5,664,299. A first profile 1016 has at least an uppermost closure element 1016*a* and a bottommost closure element 1016*b*. (U.S. Pat. No. 5,664,299, Col. 3, lines 25-27). The closure elements 1016*a* and 1016*b* project laterally from the inner surface of strip 1014. (U.S. Pat. No. 5,664,299, Col. 3, lines 27-28). Likewise, the second profile 1017 has at least an uppermost closure element 1017*a* and a bottommost closure element 1017*b*. (U.S. Pat. No. 5,664,299, Col. 3, lines 28-30). The closure elements 1017*a* and 1017*b* project laterally from the inner surface of strip 1015. (U.S. Pat. No. 5,664,299, Col. 3, lines 30-32). When the 920 bag is closed, the closure elements of profile 1016 interlock with the corresponding closure elements of profile 1017. (U.S. Pat. No. 5,664,299, Col. 3, lines 32-34). As shown in FIG. 17, closure elements 1016*a*, 1016*b*, 1017*a*, 1017*b* have hooks on the ends of the closure elements, so that the profiles remain interlocked when the bag is closed, thereby forming a seal. (U.S. Pat. No. 5,664,299, Col. 3, lines 34-37).

The straddling slider 934 has side walls 994, 996 depending from a top portion 990. A separator 992 depends from the top portion 990 between the side walls 994, 996 and is located between the uppermost closure elements 1016*a* and 1017*a* of profiles 1016 and 1017. The fastening assembly includes ridges 1025 on the outer surfaces of the fastening strips 930 and 932, and shoulders 1014, 1020 on the side walls of the slider. The shoulders act as means for maintaining the slider in straddling relation with the fastening strips by grasping the lower surfaces of the ridges 1025.

Fastening strip passages 1022, 1024 are configured to sealingly engage the fastening strips 930, 932, respectively. In addition, the passages 1022, 1024 may provide support for the fastening strips 930, 932. More specifically, first and second side surfaces 1000, 1002 of the separator 992 conform to the first and the second closure elements 1016, 1017, respectively, to provide a seal. In addition, the side surfaces 1000, 1002 may provide support for the fastening strips.

The first side surface 1000 of the separator 992 has a profile that includes a groove 1029 configured to receive the first profile 1016 and to provide a seal between the slider 934 and the first fastening strip 930. A second side surface 1002 of the separator 992 has a profile that includes a groove 1033 configured to receive the second profile 1017 and to provide a seal between the slider 934 and the second fastening strip 932. The slider 934 is similar in other respects to the slider 134 as shown in FIGS. 1-11 and herein discussed.

FIG. 18 shows another embodiment which shows another type of fastening strips. A container 1110 is in the form of a plastic bag 1120 having a sealable closure device 1121. The bag 1120 includes a first side wall 1122 and a second side wall 1124. The closure device 1121 includes a first fastening strip 1130, a second fastening strip 1132, and a slider 1134.

The first and the second fastening strips 1130, 1132 are "rolling action" fastening strips as described in U.S. Pat. No. 5,007,143. The second and the first strips 1132 and 1130 respectively include profiled tracks 1218 and 1219 extending along the length thereof parallel to the rib and groove elements 1216 and 1217, and the rib and groove elements 1216, 1217 have complimentary cross-sectional shapes such that they are closed by pressing the bottom of the elements together first and then rolling the elements to a closed position toward the top thereof. (U.S. Pat. No. 5,007,143, Col. 4, line 62 to Col. 5, line 1). The rib element 1216 is hook shaped and projects from the inner face of the second fastening strip 1132. (U.S. Pat. No. 5,007,143, Col. 5, lines 1-3). The groove element 1217 includes a lower hook-shaped projection 1217*a* and a relatively straight projection 1217*b* which extend from the inner face of the first fastening strip 1130. (U.S. Pat. No. 5,007,143, Col. 5, lines 3-6). The profiled tracks 1218 and 1219 are inclined inwardly toward each other from their respective strips 1232 and 1230. (U.S. Pat. No. 5,007,143, Col. 5, lines 6-8).

The straddling slider 1134 comprises a top portion 1190 for moving along the top edges of the tracks 1218 and 1219 with side walls 1194 and 1196 depending therefrom for cooperating with the tracks and extending from an opening end of the slider to a closing end. A separator 1192 depends from the top portion 1190 between the side walls 1194 and 1196 and is inserted between the inclined tracks 1218 and 1219. The slider 1134 has shoulders 1214, 1220 projecting inwardly from the depending side walls 1192, 1194, respectively, which are shaped throughout the length thereof for cooperation with the depending separator 1192 in creating the rolling action in opening and closing the reclosable interlocking rib and groove profile elements 1216 and 1217.

First and second fastening strip passages 1222, 1224 are configured to sealingly engage the first and second fastening strips 1130, 1132, respectively. In addition, the passages 1222, 1224 may provide support for the fastening strips 1130, 1132. More specifically, first and second side surfaces 1200, 1202 of the separator 1192 conform to the groove and the rib closure elements 1217, 1216, respectively, to provide a seal. In addition, the side surfaces 1200, 1202 may provide support for the fastening strips.

The first side surface 1200 of the separator 1192 is profiled to conform generally to the groove element 1217. The first side surface 1200 has a profile that includes a key 1225 configured to provide a seal between the slider 1134 and the first fastening strip 1130. The second side surface 1202 is profiled to conform generally to the rib element 1216. The second side surface 1202 has a profile that includes a tapered key 1231 configured to provide a seal between the slider 1134 and the second fastening strip 1132. The slider 1134 is similar in other respects to the slider 134 as shown in FIGS. 1-11 and herein described.

Figure 19:
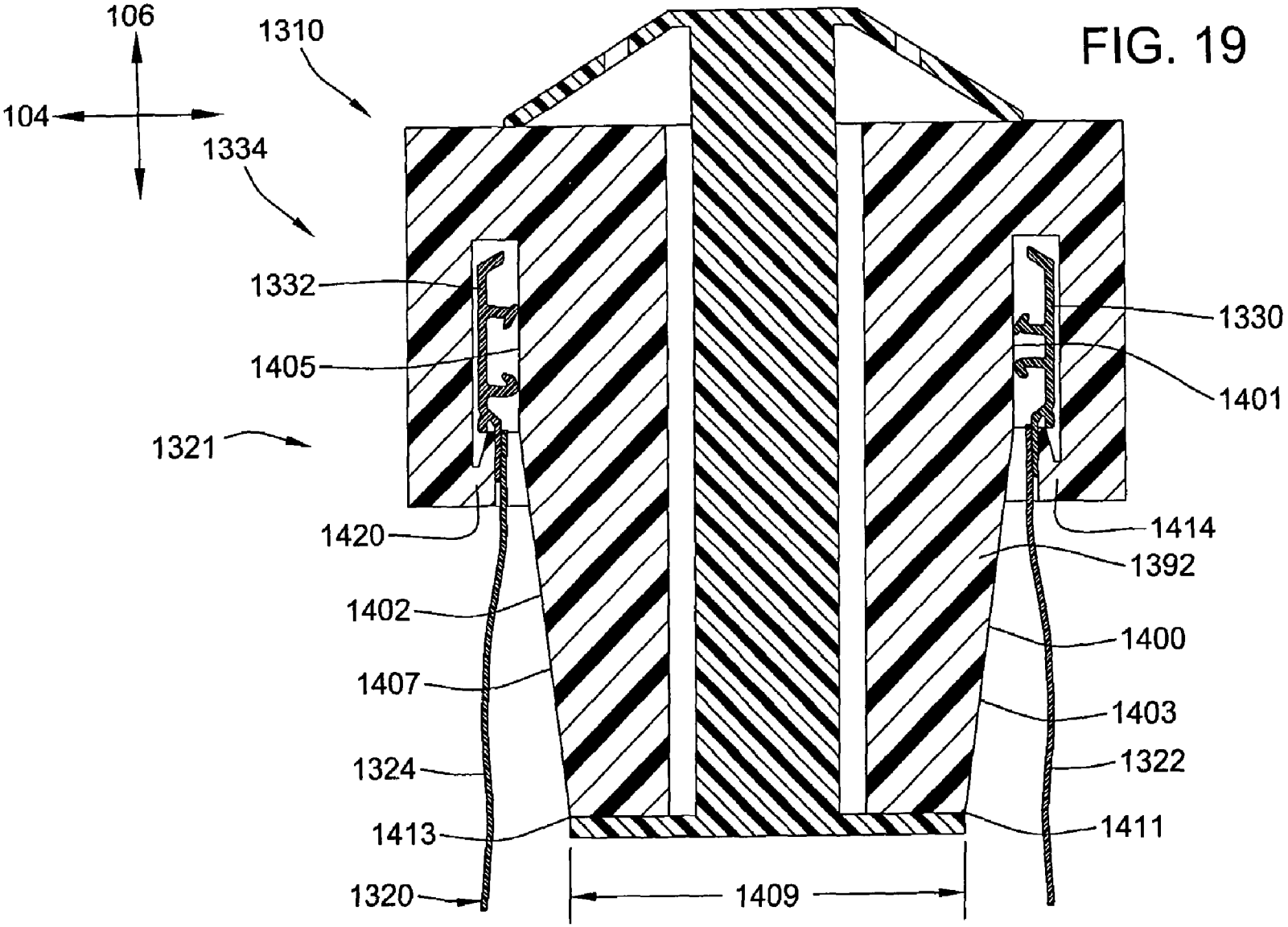
FIG. 19 is a partial cross-sectional view of another embodiment of a container.

Referring to FIG. 19, an embodiment of a slider with a tapered separator is shown. A container 1310 is in the form of a plastic bag 1320 having a sealable closure device 1321. The bag 1320 includes a first side wall 1322 and a second side wall 1324. The closure device 1321 includes a first fastening strip 1330, a second fastening strip 1332, and a slider 1334.

The slider 1334 includes a separator 1392. The separator 1392 may be tapered. The tapered separator 1392 can facilitate assembly when inserting the separator between the fastening strips 1330, 1332. The separator 1392 includes a first side surface 1400 and a second side surface 1402. The side surfaces 1400, 1402 extend substantially the entire length of the separator 1392, measured along the X axis 102. The first side surface 1400 includes a substantially vertical portion 1401 and a tapered portion 1403. The second side surface 1402 includes a substantially vertical portion 1405 and a tapered portion 1407. The vertical portions 1401, 1405 are substantially parallel to each other along the Z axis 106. The tapered portions 1403, 1407 depend from the vertical portions 1401, 1405, respectively, and terminate a predetermined distance below a pair of shoulders 1414, 1420. The tapered portions 1403, 1407 converge toward each other, moving downward along the Z axis 106. The tapered portions 1403, 1407 are separated a minimum distance 1409 from each other at edges 1411, 1413 where the tapered portions 1403, 1407 respectively meet a bottom surface 1404 of the separator 1392. The slider 1334 is similar in other respects to the slider 134 as shown in FIGS. 1-11 and herein described.

Figure 20:
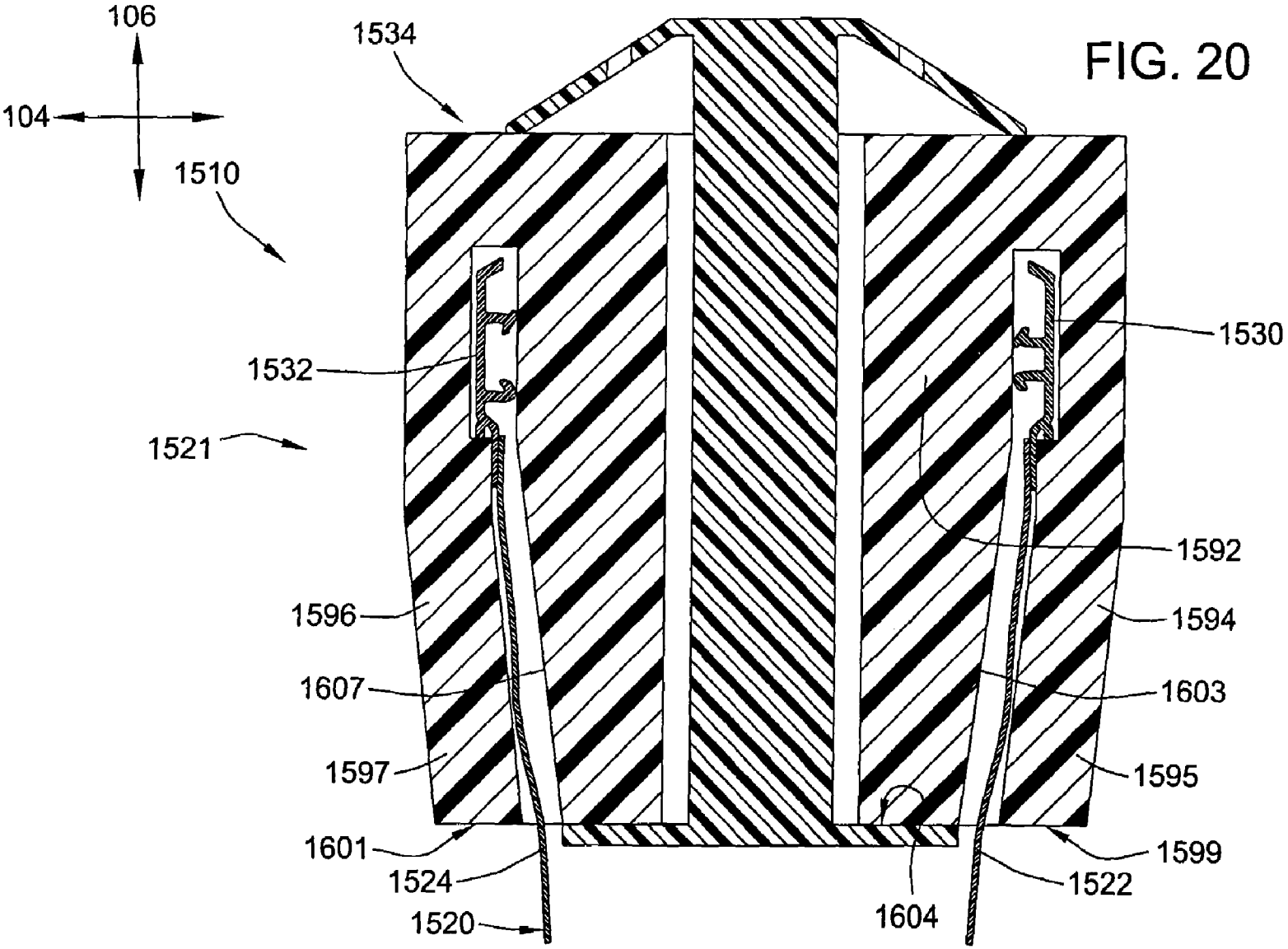
FIG. 20 is a partial cross-sectional view of another embodiment of a container.
Figure 21:
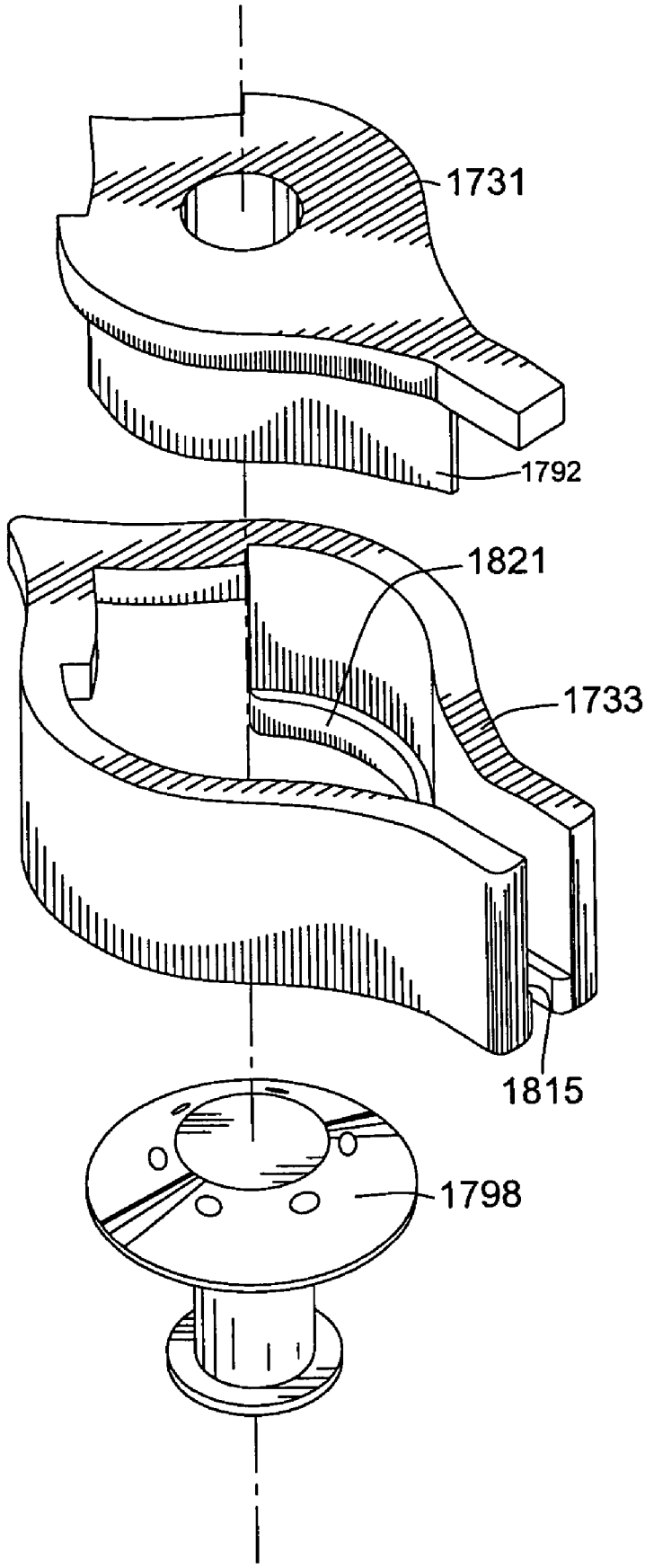
FIG. 21 is an exploded view of an embodiment of a slider having a two-piece construction.

Referring to FIG. 20, an embodiment of a slider with a tapered separator and tapered side walls is shown. A container 1510 is in the form of a plastic bag 1520 having a sealable closure device 1521. The bag 1520 includes a first side wall 1522 and a second side wall 1524. The closure device 1521 includes a first fastening strip 1530, a second fastening strip 1532, and a slider 1534. The slider 1134 includes a separator 1592 that is tapered and similar in other respects to the separator 1392 as shown in FIG. 18 and herein described.

Side walls 1594, 1596 of the slider 1134 extend along the Z axis 106 a predetermined distance below the fastening strips 1530, 1532. The sidewalls 1594, 1596 each include a respective tapered portion 1595, 1597. The tapered portions 1595, 1597 are generally parallel to tapered portions 1603, 1607 of the separator 1592, respectively. The tapered portions 1595, 1597 of the side walls 1594, 1594 terminate at bottom surfaces 1599, 1601 that are substantially planar with a bottom surface 1604 of the separator 1592. The slider 1534 is similar in other respects to the slider 134 as shown in FIGS. 1-11 and herein described.

The slider may be made from one piece or multiple parts. For example, referring to FIGS. 21-24, an embodiment of a slider 1734 is shown. The slider 1734 includes a cap 1731, a base 1733, and a valve 1798. The cap 1731 includes a depending separator 1792. The base 1733 includes a pair of shoulders 1815, 1821. The cap 1731 and the base 1733 can be assembled by any known method, such as, snap-fitting, press-fitting, fusing, or welding, for example. The valve 1798 can be assembled to the cap 1731 by inserting the valve 1798 into the bottom of the opening as noted above.

Figure 22:
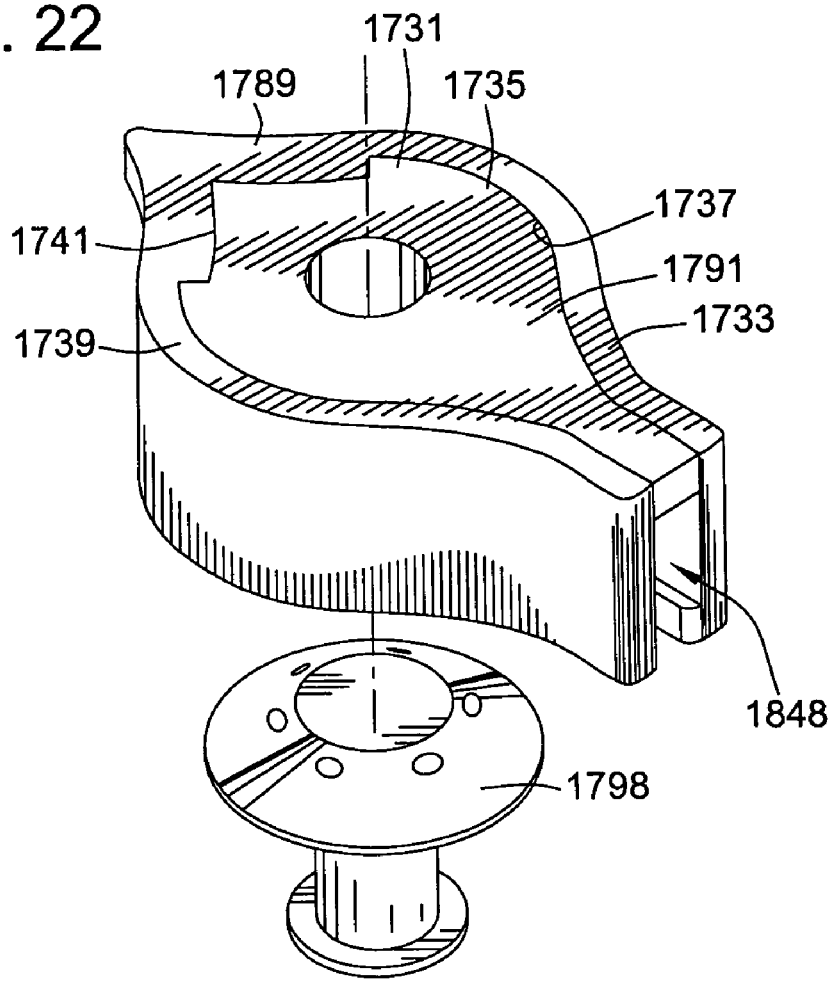
FIG. 22 is an exploded view of the slider in FIG. 21.
Figure 23:
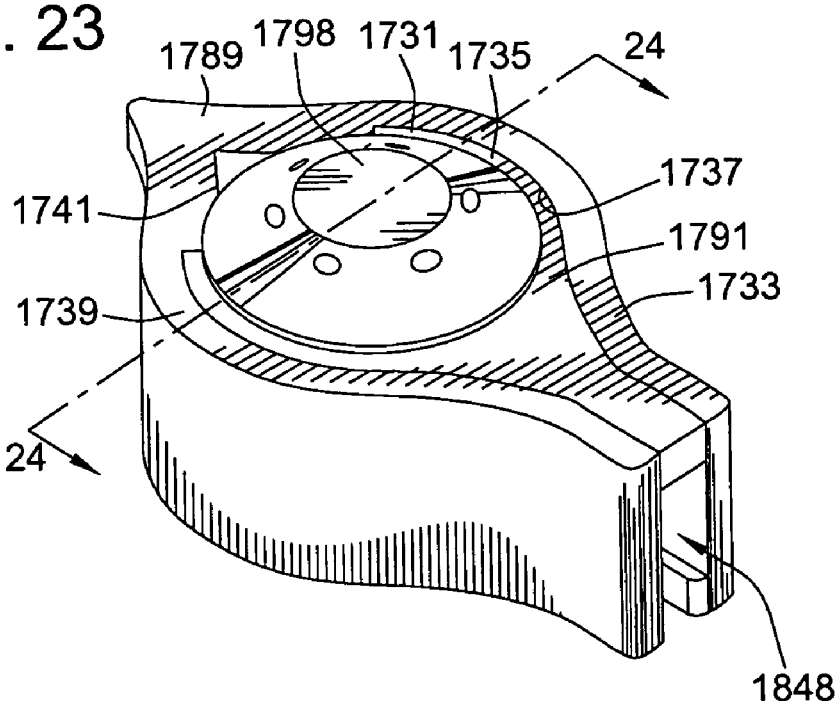
FIG. 23 is a perspective view of the slider in FIG. 21.

Referring to FIG. 22, a top portion 1791 of the cap 1731 includes a perimeter 1737. A top portion 1789 of the base 1733 includes an inner edge 1741. The shape of the perimeter 1737 of the cap 1731 closely conforms to the shape of the inner edge 1741 of the base 1733. Once assembled the cap 1731 and the base 1733 create an occlusion passage 1848.

Figure 24:
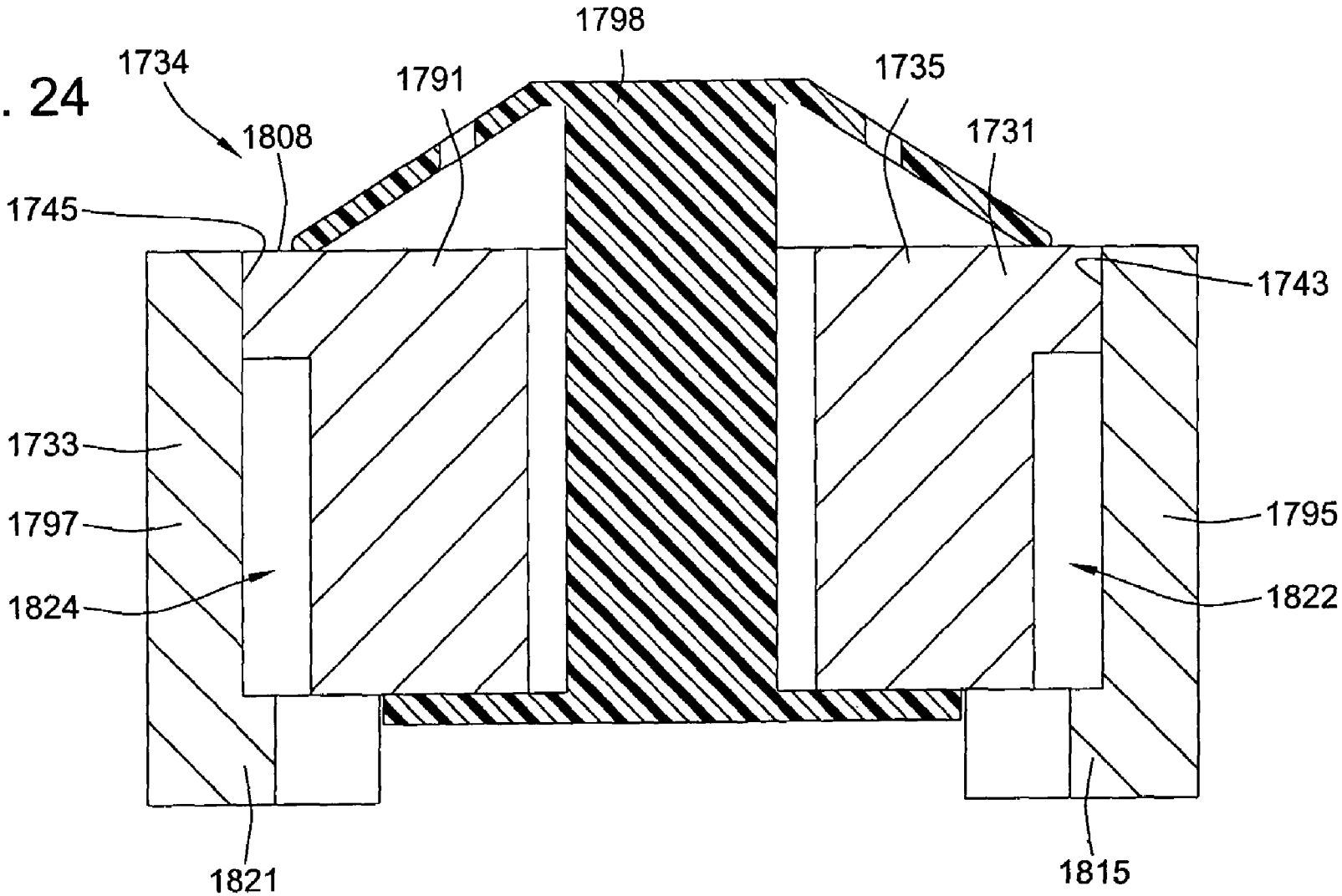
FIG. 24 is a cross-sectional view of the slider taken along line 24-24 in FIG. 23.

Referring to FIG. 24, the assembled slider 1734 presents a flush top surface 1808. The shoulders 1815, 1821 can provide support for the cap 1731. Side surfaces 1743, 1745 of the top portion 1791 of the cap 1731 are in respective contacting relation with side walls 1795, 1797 of the base 1733 to provide a connection as noted above between the cap 1731 and the base 1733. Once assembled, the cap 1731 and the base 1733 create a first passage 1822 and a second passage 1824.

The cap 1731 and the base 1733 may be made from different materials. For example, the cap 1731 can be made of a material that is soft relative to the base 1733, such as, neoprene rubber or silicone rubber and the base 1733 can be made of a material that is hard relative to the cap 1731, such as, nylon, polypropylene, polystyrene, acetyl, toughened acetyl, polyketone, polybutylene terrephthalate, high density polyethylene, polycarbonate or ABS (acrylonitrile-butadiene-styrene). By making the cap 1731 and the base 1733 out of material with different degrees of hardness, assembly is facilitated. The slider 1734 is similar in other respects to the slider 134 as shown in FIGS. 1-11 and herein described.

Although several combinations of interlocking fastening strip embodiments and slider embodiments have been specifically described and illustrated herein, it will be readily appreciated by those skilled in the art that other kinds, types, or forms of fastening strips and/or sliders can alternatively be used without departing from the scope or spirit of the present invention.

The interlocking fastening strips may be manufactured by extrusion through a die. The interlocking fastening strips may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to prepare the interlocking fastening strips.

When the fastening strips are used in a sealable bag, the fastening strips and the films that form the body of the bag may be conveniently manufactured from heat sealable material. In this way, the bag may be economically formed by using an aforementioned thermoplastic material and by heat sealing the fastening strips to the bag. For example, the bag may be made from a mixture of high pressure, low density polyethylene and linear, low density polyethylene.

The fastening strips may be manufactured by extrusion or other known methods. For example, the closure device may be manufactured as individual fastening strips for later attachment to the bag or may be manufactured integrally with the bag. In addition, the fastening strips may be manufactured with or without flange portions on one or both of the fastening strips depending upon the intended use of the fastening strips or expected additional manufacturing operations.

Generally, the fastening strips can be manufactured in a variety of forms to suit the intended use. The fastening strips may be integrally formed on the opposing side walls of the container or bag or connected to the container by the use of any of many known methods. For example, a thermoelectric device may be applied to a film in contact with the flange portion of the fastening strips or the thermoelectric device may be applied to a film in contact with the base portion of fastening strips having no flange portion to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding may be done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

In addition, the slider can be colored, opaque, translucent or transparent. The slider may be injection molded or made by any other method. The slider may be molded from any suitable plastic material, such as, nylon, polypropylene, polystyrene, acetyl, toughened acetyl, polyketone, polybutylene terrephthalate, high density polyethylene, polycarbonate or ABS (acrylonitrile-butadiene-styrene).

The valve may be made of a single piece or of multiple parts that are snapped, fused, or welded together. The valve can be colored, opaque, translucent or transparent. The valve may be injection molded or made by any other method. The valve may be molded from any suitable material, such as, neoprene rubber or silicone rubber.

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. All of the references cited herein, including patents, patent applications, and publications, are hereby incorporated by reference in their entireties.

What is claimed is:

1. A slider comprising:

a top portion;

a first side wall including a tapered portion depending from the top portion;

a second side wall including a tapered portion depending from the top portion; and a separator depending from the top portion and disposed between the first side wall and the second side wall, the separator including a first side surface having a tapered portion and a second side surface having a tapered portion, the surfaces form a tapered plug for providing a seal between the slider and a pair of fastening strips, wherein the tapered portion of the first side wall is substantially parallel to the tapered portion of the first side surface of the separator, and the tapered portion of the second side wall is substantially parallel to the tapered portion of the second side surface of the separator and wherein the first side surface of the separator includes an upper rib and a lower rib, the upper and the lower ribs form a channel.

2. The slider according to claim 1 wherein the first side surface and the second side surface form a wedge for deoccluding the fastening strips.

3. The slider according to claim 1 wherein the second side surface of the separator includes a profile.

4. The slider according to claim 3 wherein the profile is selected from the group consisting of a key, a channel, a groove, and a recess.

5. The slider according to claim 1 wherein the first side wall and the second side wall each includes an inner surface, an outer surface, and a shoulder.

6. The slider according to claim 1 wherein the slider comprises a multiple-piece construction.

7. The slider according to claim 6 wherein the slider comprises a cap and a base.

8. The slider according to claim 7 wherein the cap and the base are assembled by snap-fitting.

9. The slider according to claim 7 wherein the cap and the base comprise different materials.

10. A slider comprising:

a top portion;

a first side wall depending from the top portion;

a second side wall depending from the top portion; and a separator depending from the top portion and disposed between the first side wall and the second side wall, the separator including a first side surface and a second side surface, the surfaces form a tapered plug for providing a seal between the slider and a pair of fastening strips, wherein the top portion, the first side wall, the second side wall, and the separator form a first passage, a second passage, and an occlusion passage, the first passage and the second passage both communicating with the occlusion passage and wherein the first side surface of the separator includes an upper rib and a lower rib, the upper and the lower ribs form a channel.

11. The slider according to claim 10 wherein the first side surface and the second side surface form a wedge for deoccluding the fastening strips.

12. The slider according to claim 10 wherein the second side surface of the separator includes a profile.

13. The slider according to claim 12 wherein the profile is selected from the group consisting of a key, a channel, a groove, and a recess.

14. The slider according to claim 10 wherein the first side wall and the second side wall each includes an inner surface, an outer surface, and a shoulder.

15. The slider according to claim 10 wherein the first side wall and the second side wall each includes a tapered portion.

16. The slider according to claim 10 wherein the slider comprises a multiple-piece construction.

17. The slider according to claim 16 wherein the slider comprises a cap and a base.

18. The slider according to claim 17 wherein the cap and the base are assembled by snap-fitting.

19. The slider according to claim 17 wherein the cap and the base comprise different materials.

20. A slider comprising:

a top portion;

a first side wall depending from the top portion;

a second side wall depending from the top portion;

a separator depending from the top portion and disposed between the first side wall and the second side wall; and a valve, wherein the separator includes a first side surface and a second side surface, and the surfaces form a wedge for deoccluding a pair of fastening strips and a tapered plug for providing a seal between the slider and the fastening strips.

21. The slider according to claim 20 wherein the slider further comprises an opening, the valve being movably disposed in the opening.

22. The slider according to claim 20 wherein the opening extends through the top portion and the separator.

23. The slider according to claim 20 wherein the valve includes a mating surface, the mating surface being configured to mate with a surface of the separator to provide a seal when the valve is in a closed position.

24. The slider according to claim 20 wherein the valve includes means for biasing the valve to a closed position wherein the valve and the separator cooperate to provide a seal.

25. The slider according to claim 20 wherein the valve includes a stem, a head, and a flange portion.

26. The slider according to claim 25 wherein the head of the valve includes a mating surface, the mating surface being configured to mate with a surface of the separator to provide a seal when the valve is in a closed position.

27. The slider according to claim 26 wherein the valve includes means for biasing the valve to the closed position.

28. The slider according to claim 26 wherein the flange portion of the valve includes a resiliently flexible skirt, the skirt biasing the valve to the closed position.

29. The slider according to claim 28 wherein the skirt includes a plurality of holes.

30. The slider according to claim 20 farther comprising a nose portion for latching the slider.

31. A slider comprising:

a top portion;

a first side wall depending from the top portion;

a second side wall depending from the top portion;

a separator depending from the top portion and disposed between the first side wall and the second side wall; and a nose portion for latching the slider, wherein the separator includes a first side surface and a second side surface, the surfaces form a wedge for deoccluding a pair of fastening strips and a tapered plug for providing a seal between the slider and the fastening strips.

32. The slider according to claim 31 wherein the nose portion includes a catch.

33. The slider according to claim 31 wherein the nose portion includes a notch.

34. A closure device comprising:

a first fastening strip;

a second fastening strip, the first fastening strip and the second fastening strip being adapted to interlock with each other over a predetermined length between first and second ends thereof and are secured together at the first end and the second end; and a slider, the slider being movably disposed on the first fastening strip and the second fastening strip, the slider facilitating the occlusion of the fastening strips when moved toward the first end thereof and facilitating the deocclusion of the fastening strips when moved toward the second end thereof, and the slider including a separator, the separator being disposed between the first fastening strip and the second fastening strip, the separator including a first side surface and a second side surface, the surfaces form a tapered plug for providing a seal between the slider and the fastening strips when the slider is adjacent the first end of the fastening strips, wherein the first side surface of the separator includes a channel, the second side surface of the separator includes a key, the first fastening strip includes a first closure element, the first closure element of the first fastening strip is disposed within the channel of the first side surface of the separator, the second fastening strip includes a second closure element, and the key of the second side surface of the separator is disposed within the second closure element of the second fastening strip.

35. The slider according to claim 34 wherein the first side surface and the second side surface of the slider form a wedge for deoccluding the fastening strips.

36. The slider according to claim 34 wherein the first end and the second end of the fastening strips include a first melted portion and a second melted portion, respectively.

37. The slider according to claim 34 wherein the first fastening strip and the second fastening strip comprise U-channel fastening strips.

38. The slider according to claim 34 wherein the slider includes a top portion, a first side wall, and a second side wall.

39. The slider according to claim 38 wherein the top portion, the first side wall, the second side wall, and the separator form a first passage, a second passage, and an occlusion passage, the first passage and the second passage both communicating with the occlusion passage, the first fastening strip extending through the first passage and the occlusion passage, and the second fastening strip extending through the second passage and the occlusion passage.

40. The slider according to claim 34 wherein the first fastening strip and the second fastening strip comprise "rib and groove" fastening strips.

41. The slider according to claim 34 wherein the first fastening strip includes a groove element, the second fastening strip includes a rib element, the first side surface of the separator includes a recess, the second side surface of the separator includes a recess, the groove element of the first fastening strip is disposed within the recess of the first side surface of the separator, and the rib element of the second fastening strip is disposed within the recess of the second side surface of the separator.

42. The slider according to claim 34 wherein the first fastening strip and the second fastening strip comprise "profile" fastening strips.

43. The slider according to claim 34 wherein the first fastening strip includes a first profile, the second fastening strip includes a second profile, the first side surface of the separator includes a groove, the second side surface of the separator includes a groove, the first profile of the first fastening strip is disposed within the groove of the first side surface of the separator, and the second profile of the second fastening strip is disposed within the groove of the second side surface of the separator.

44. The slider according to claim 34 wherein the first fastening strip and the second fastening strip comprise "rolling action" fastening strips.

45. The slider according to claim 34 wherein the first fastening strip includes a first rib and groove element, the second fastening strip includes a second rib and groove element, the first side surface of the separator includes a key, the second side surface of the separator includes a key, the key of the first side surface of the separator is disposed within the first rib and groove element of the first fastening strip, and the key of the second side surface of the separator is disposed within the second rib and groove element of the second fastening strip.

46. A closure device, comprising:

a first fastening strip;

a second fastening strip, the first fastening strip and the second fastening strip being adapted to interlock with each other over a predetermined length between first and second ends thereof and being secured together at the first end and the second end; and a slider, the slider being movably disposed on the first fastening strip and the second fastening strip, the slider interlocking the fastening strips when the slider moves toward the first end, and the slider including a valve, wherein the slider includes a separator, the separator is disposed between the first fastening strip and the second fastening strip, the separator includes a first side surface and a second side surface, and the surfaces form a wedge for deoccluding the fastening strips and a tapered plug for providing a seal between the slider and the fastening strips when the slider is adjacent the first end of the fastening strips.

47. The slider according to claim 46 further comprising a nose portion for latching the slider.

* * * * *